US009611871B2

(12) United States Patent
Kot

(10) Patent No.: US 9,611,871 B2
(45) Date of Patent: Apr. 4, 2017

(54) PNEUMATIC VALVE ASSEMBLY AND METHOD

(71) Applicant: Norbert J. Kot, Brookfield, WI (US)

(72) Inventor: Norbert J. Kot, Brookfield, WI (US)

( * ) Notice: Subject to any disclaimer, the term of this patent is extended or adjusted under 35 U.S.C. 154(b) by 49 days.

(21) Appl. No.: 14/486,770

(22) Filed: Sep. 15, 2014

(65) Prior Publication Data

US 2015/0075640 A1 Mar. 19, 2015

Related U.S. Application Data

(60) Provisional application No. 61/877,657, filed on Sep. 13, 2013.

(51) Int. Cl.
*F15B 13/042* (2006.01)
*F15B 13/02* (2006.01)
*F15B 13/01* (2006.01)

(52) U.S. Cl.
CPC ..... *F15B 13/029* (2013.01); *F15B 13/01* (2013.01); *F15B 2211/3057* (2013.01); *F15B 2211/30505* (2013.01); *F15B 2211/30515* (2013.01); *F15B 2211/5059* (2013.01); *F15B 2211/50581* (2013.01); *F15B 2211/761* (2013.01); *F15B 2211/8613* (2013.01); *F15B 2211/8855* (2013.01); *Y10T 137/2554* (2015.04); *Y10T 137/87241* (2015.04)

(58) Field of Classification Search
CPC .. F15B 2211/30505; F15B 2211/30515; F15B 2211/3057; F15B 2211/50581; F15B 2211/5059; F15B 2211/761; F15B 2211/8613; F15B 2211/8855; F15B 13/01; F15B 13/029; Y10T 137/2554; Y10T 137/87193; Y10T 137/87241; Y10T 137/87249
USPC ..... 137/106, 596.14, 596.2, 597
See application file for complete search history.

(56) References Cited

U.S. PATENT DOCUMENTS

| | | | |
|---|---|---|---|
| 2,310,100 | A | 2/1943 | Losey et al. |
| 2,478,002 | A | 8/1949 | Mott |
| 2,750,743 | A | 6/1956 | Korkowski et al. |
| 2,811,958 | A | 11/1957 | Roush, Jr. |
| 2,837,106 | A | 6/1958 | Bauer |

(Continued)

FOREIGN PATENT DOCUMENTS

| | | |
|---|---|---|
| CH | 334050 | 11/1958 |
| DE | 1217212 | 5/1966 |

(Continued)

OTHER PUBLICATIONS

NGT LLC, MAC® Balanced Poppet 3-Way and 4-Way Air Valves, Mar. 29, 1999.

(Continued)

*Primary Examiner* — William McCalister
(74) *Attorney, Agent, or Firm* — Ryan Kromholz & Manion, S.C.

(57) ABSTRACT

A valve assembly for receiving a fluid under pressure and comprising a plurality of valves in a single valve block. The assembly may include a plurality of check valves and including a counterbalance generating valve and a 3-way valve and including a method of use. The assembly may include an adjustable counterbalance valve, a pilot-operated check valve and a 3-way valve or combinations thereof.

6 Claims, 21 Drawing Sheets

(56) References Cited

U.S. PATENT DOCUMENTS

| | | | | | |
|---|---|---|---|---|---|
| 2,959,188 | A | | 11/1960 | Kepner | |
| 3,165,980 | A | | 1/1965 | Peras | |
| 3,229,721 | A | | 1/1966 | Bingel | |
| 3,272,085 | A | | 9/1966 | Hajma | |
| 3,273,468 | A | | 9/1966 | Allen | |
| 3,335,750 | A | | 8/1967 | Kepner | |
| 3,404,650 | A | | 10/1968 | Miller et al. | |
| 3,410,304 | A | | 11/1968 | Paul, Jr. | |
| 3,472,261 | A | | 10/1969 | Brannon | |
| 3,527,250 | A | | 9/1970 | Thomas et al. | |
| 3,595,264 | A | | 7/1971 | Martin | |
| 3,613,508 | A | * | 10/1971 | Krehbiel | F15B 13/04 137/596.2 |
| 3,641,880 | A | | 2/1972 | Honeycutt | |
| 3,714,868 | A | | 2/1973 | Kowalski et al. | |
| 3,747,351 | A | | 7/1973 | Wilkerson et al. | |
| 3,792,715 | A | | 2/1974 | Parrett et al. | |
| 3,799,032 | A | | 3/1974 | Honeycutt | |
| 3,817,154 | A | | 6/1974 | Martin | |
| 3,818,936 | A | | 6/1974 | Jackoboice et al. | |
| 3,893,471 | A | | 7/1975 | Byers, Jr. | |
| 3,906,991 | A | * | 9/1975 | Haussler | F15B 13/015 137/630.13 |
| 3,908,687 | A | | 9/1975 | Wood | |
| 3,933,167 | A | * | 1/1976 | Byers, Jr. | F15B 13/015 137/106 |
| 3,943,824 | A | | 3/1976 | Fletcher | |
| 3,975,987 | A | | 8/1976 | Panis | |
| 3,980,336 | A | | 9/1976 | Bitonti | |
| 3,981,479 | A | | 9/1976 | Foster et al. | |
| 4,012,031 | A | * | 3/1977 | Mitchell | A61G 13/02 5/614 |
| 4,018,136 | A | | 4/1977 | Kaetterhenry | |
| 4,040,600 | A | | 8/1977 | Coppola et al. | |
| 4,172,582 | A | * | 10/1979 | Bobnar | F15B 11/003 251/282 |
| 4,192,338 | A | | 3/1980 | Gerulis | |
| 4,244,275 | A | | 1/1981 | Smilges | |
| 4,266,466 | A | | 5/1981 | Ziems | |
| 4,287,812 | A | | 9/1981 | Iizumi | |
| 4,291,718 | A | | 9/1981 | Sanin et al. | |
| 4,310,062 | A | * | 1/1982 | Link | B62D 5/09 180/420 |
| 4,397,221 | A | | 8/1983 | Friesen et al. | |
| 4,500,069 | A | | 2/1985 | Barber et al. | |
| 4,513,979 | A | | 4/1985 | Silverman | |
| 4,531,449 | A | | 7/1985 | Reith | |
| 4,694,730 | A | | 9/1987 | Krieger et al. | |
| 4,727,792 | A | | 3/1988 | Häussler | |
| 4,793,590 | A | | 12/1988 | Watson | |
| 4,838,306 | A | | 6/1989 | Horn et al. | |
| 4,838,532 | A | | 6/1989 | Horn et al. | |
| 5,018,935 | A | * | 5/1991 | Gage | F15B 13/01 137/106 |
| 5,081,904 | A | | 1/1992 | Horn et al. | |
| 5,178,191 | A | | 1/1993 | Schaefer | |
| 5,188,015 | A | | 2/1993 | Hageman | |
| 5,211,196 | A | | 5/1993 | Schwelm | |
| 5,349,818 | A | * | 9/1994 | McFadyen | B63H 25/22 137/106 |
| 5,400,816 | A | | 3/1995 | Gerstenberger | |
| 5,481,871 | A | | 1/1996 | McFadyen | |
| 5,520,091 | A | * | 5/1996 | Chromik | F15B 15/261 5/614 |
| 5,542,336 | A | * | 8/1996 | Larkin | F15B 9/03 91/166 |
| 5,676,169 | A | | 10/1997 | Landrum | |
| 5,832,808 | A | * | 11/1998 | Ishizaki | F15B 11/024 137/625.63 |
| RE36,342 | E | | 10/1999 | McFadyen et al. | |
| 5,960,814 | A | | 10/1999 | Kot | |
| 6,065,288 | A | | 5/2000 | Glomeau | |
| 6,173,639 | B1 | * | 1/2001 | A'Hearn | F15B 11/003 91/437 |
| 6,176,261 | B1 | * | 1/2001 | Heusser | F15B 13/01 137/596.13 |
| 6,220,289 | B1 | | 4/2001 | Zenker et al. | |
| 6,477,937 | B1 | | 11/2002 | Horn et al. | |
| 6,499,505 | B2 | * | 12/2002 | Zenker | F15B 11/003 137/596.2 |
| 6,516,706 | B2 | * | 2/2003 | Porter | F15B 1/265 91/420 |
| 6,871,574 | B2 | | 3/2005 | Barber | |
| 6,997,210 | B2 | | 2/2006 | Horn et al. | |
| 7,216,578 | B2 | * | 5/2007 | Mentink | F15B 11/042 91/421 |
| 7,921,878 | B2 | * | 4/2011 | Coolidge | F15B 13/0417 137/625.68 |
| 8,014,897 | B2 | * | 9/2011 | Norman | A63H 11/00 180/168 |
| 8,333,218 | B2 | * | 12/2012 | Walsh | F15B 13/0431 137/596.16 |
| 8,485,223 | B2 | * | 7/2013 | Ku | F15B 13/0402 137/596 |
| 8,671,824 | B2 | * | 3/2014 | Kauss | F15B 11/003 91/421 |
| 8,763,639 | B2 | * | 7/2014 | Cook | F16F 9/466 137/625.37 |
| 2004/0112208 | A1 | | 6/2004 | Kot, II | |

FOREIGN PATENT DOCUMENTS

| | | |
|---|---|---|
| DE | 1943090 | 3/1971 |
| DE | 2449599 | 4/1976 |
| FR | 1071100 | 8/1954 |
| GB | 449876 | 7/1936 |
| GB | 603795 | 6/1948 |
| GB | 1379455 | 1/1975 |
| JP | 57-12170 | 1/1982 |
| SU | 379801 | 4/1973 |
| SU | 670260 | 6/1979 |
| SU | 671765 | 7/1979 |
| SU | 674706 | 7/1979 |
| WO | WO98/20260 | 5/1998 |

OTHER PUBLICATIONS

NGT, LLC Catalog, NGT Specialty Valves, Current as of Jan. 12, 2010.

USPTO Office Action dated Sep. 29, 1998 regarding U.S. Appl. No. 08/928,935, 5 pages.

* cited by examiner

PNEUMATIC VALVE ASSEMBLY AND METHOD

RELATED APPLICATION

The present invention claims priority to U.S. Provisional Patent Application Ser. No. 61/877,657, filed 13 Sep. 2013.

FIELD OF THE INVENTION

The invention relates in general to fluid pressure operated systems and devices, particularly pneumatic valve assemblies used to position heavy objects, such as boat gangways.

BACKGROUND OF THE INVENTION

Systems and devices using fluid pressure for lifting and holding position are known. These systems and devices typically include check valves, which prevent sudden and potentially damaging loss of pressure when the supply of pressurized fluid unexpectedly decreases or fails. The present valve solves some of the problems related to the use of a standard dual check or a single check valve in applications which require better pneumatic control. In certain applications, using a dual check or single check alone, may cause the cylinder movement to be jerky and could cause a runaway condition when opening the valve after stopping. The present invention contemplates a single valve block configured to solve a number of design problems where pneumatic control of motion is required.

SUMMARY OF THE INVENTION

The invention provides a valve assembly for receiving a fluid under pressure and comprising a plurality of valves in a single block. The assembly may include a counterbalance valve to supply a continuous pressure to balance a load on a cylinder. The counterbalance valve is adjustable to maintain the load in an elevated position by applying constant back pressure to the air cylinder. Second, the assembly may include a pilot-operated check valve to trap air pressure on the opposite side of an air cylinder, to thereby reduce cylinder bounce. Third, the assembly may include a 3-way valve to quickly exhaust the pilot supply to the counterbalance valve, so that any movement due to load momentum does not further increase the pressure on the counterbalance valve, causing it to open, and the cylinder to drift until the system stabilizes.

An alternative valve assembly may include a pair of counterbalance valves to supply a continuous pressure to balance a load on a cylinder. Second the assembly may further include the assembly may include a pair of 3-way valves to quickly exhaust the pilot supply to each respective counterbalance valve, so that any movement due to Load momentum does not further increase the pressure on a counterbalance valve, causing it to open, and the cylinder to drift until the system stabilizes.

Another alternative assembly may include a counterbalance valve to supply a continuous pressure to balance a load on a cylinder. The counterbalance valve is adjustable to maintain the load in an elevated position by applying constant back pressure to the air cylinder. Second the assembly may include a 3-way valve to quickly exhaust the pilot supply to the counterbalance valve, so that any movement due to load momentum does not further increase the pressure on the counterbalance valve, causing it to open, and the cylinder to drift until the system stabilizes. Third, the system may include a check valve having a flow control mechanism to control air flow through the check valve.

Yet another alternative assembly may include a counterbalance valve to supply a continuous pressure to balance a load on a cylinder. The counterbalance valve is adjustable to maintain the load in an elevated position by applying constant back pressure to the air cylinder. Second, the system may include a check valve having a flow control mechanism to control air flow through the check valve.

The invention includes a valve comprising a valve body, the valve body including a first pilot bore, the first pilot bore including an input bore having an input port, an output bore having an output port, and a first cartridge spool disposed at least partially within the first pilot bore; and a second pilot bore, the second pilot bore including an input bore having an input port, an output bore having an output port, the second pilot bore including a second cartridge spool disposed at least partially within the second pilot bore. A valve according to the present invention includes a valve body which is a unitary member. A valve according to the present invention may include a flow control mechanism on one of a first pilot bore or a second pilot bore. The flow control mechanism may include a threaded adjusting screw and a bumper member mounted on a first end of the adjusting screw. The bumper member being in contact with one of a first or second cartridge spool to thereby limit the travel of the spool. The flow control mechanism may further include a lock nut threaded onto the adjusting screw and adapted to selectively prevent rotation of the adjusting screw with respect to the bumper member. A valve according to the present invention may further include a counterbalance mechanism for one of the pilot bores. The counterbalance mechanism may include a counterbalance adjusting screw and a counterbalance bias spring, the counterbalance adjusting screw biasing the bias spring in a direction against the cartridge spool to close the outlet port. A valve according to the present invention may further include a 3-way valve in fluid communication with at least one of the pilot bores. A 3-way valve may include a piston bore and a piston disposed at least partially within the piston bore, and a ball check.

DESCRIPTION OF THE PREFERRED EMBODIMENT

Figure 1:
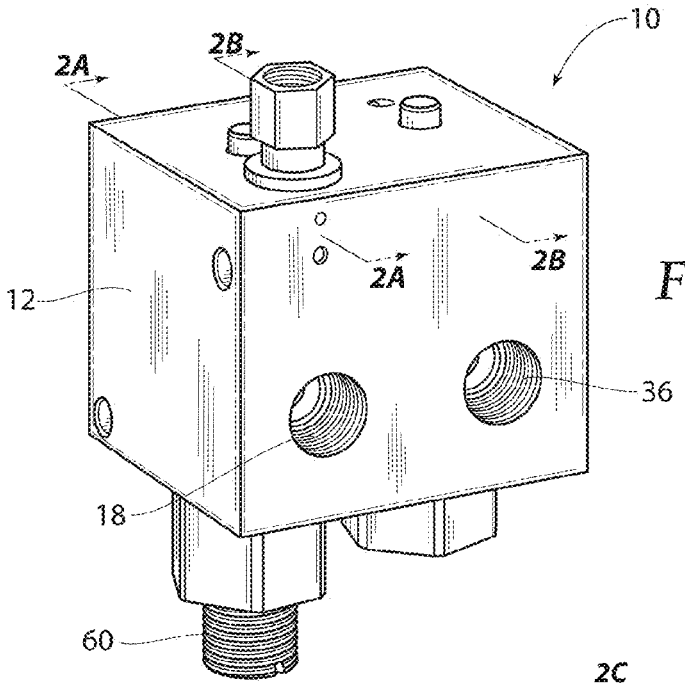
FIG. 1 is a perspective view of a valve for use in a fluid flow system according to the present invention.
Figure 2A:
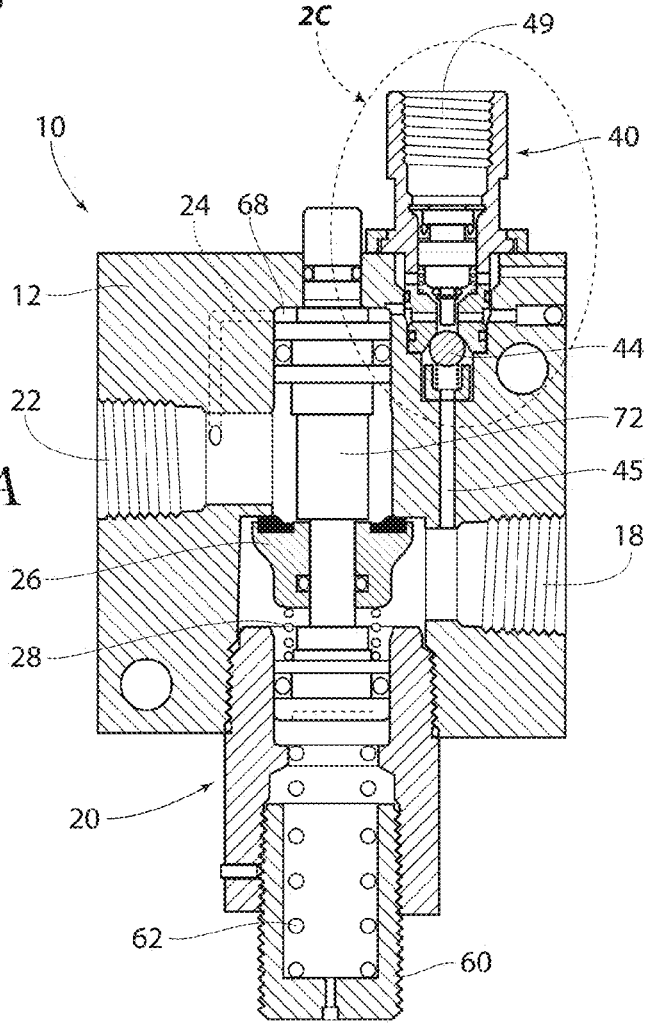
FIG. 2A is a cross sectional view of the valve shown in FIG. 1 and taken along lines 2A-2A thereof.
Figure 2B:
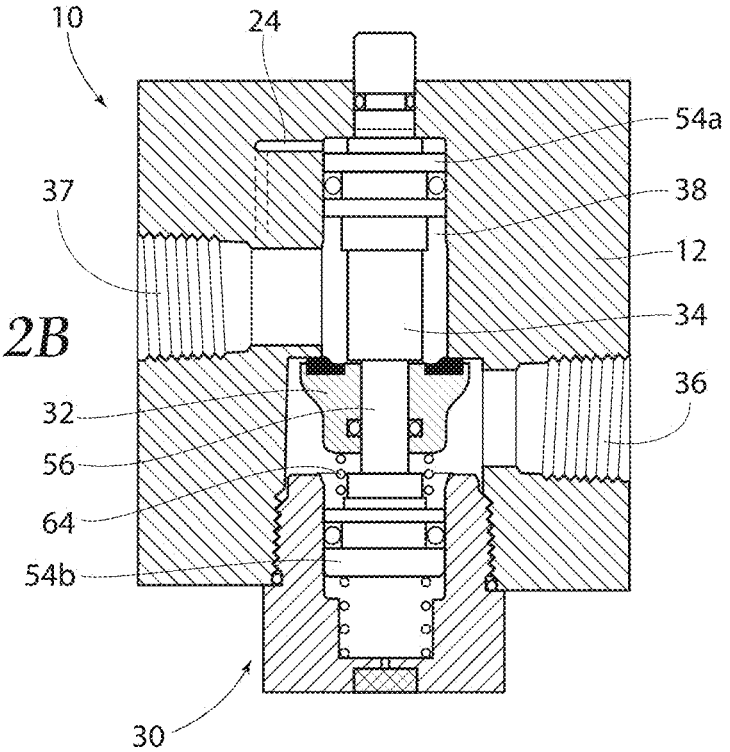
FIG. 2B is a cross sectional view of the valve shown in FIG. 1 and taken along lines 2B-2B thereof.
Figure 2C:
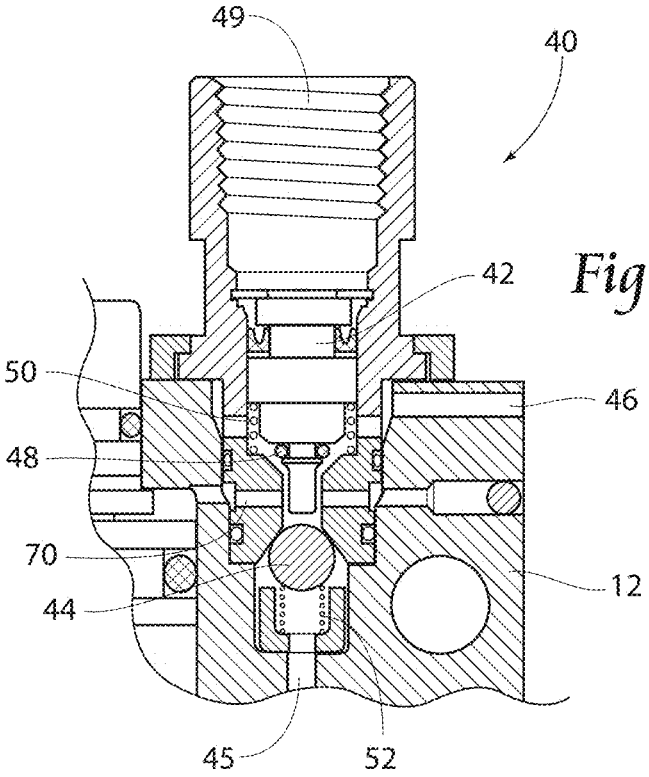
FIG. 2C is an enlarged cross sectional view of a portion of the valve shown in FIGS. 1 and 2A showing the area referenced by 2C in FIG. 2A.
Figure 3:
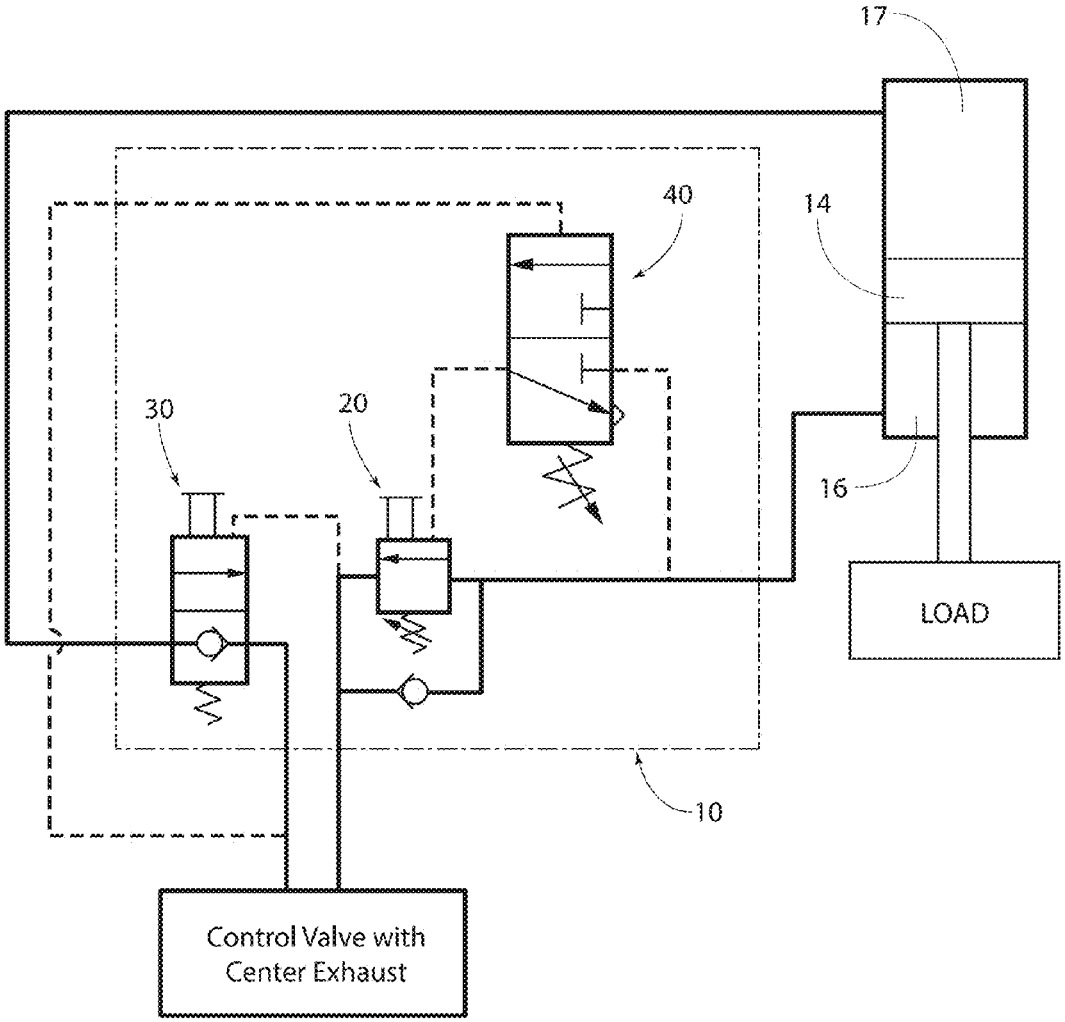
FIG. 3 is a schematic representation of the valve shown in FIG. 1 in use in a fluid flow system.

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

I. Counterbalance/3-Way and Check Valve

With specific attention to FIGS. 1-4D, a valve 10 according to the present invention may be seen. The valve configuration described and illustrated in these views is preferably used in applications requiring higher cylinder pressure in one direction of motion. An example of such an application is a vertical cylinder application, in which high pressure is required to lift the load and very little pressure is required to lower the load, because gravity does most of the work in one direction. Using a typical dual check or single pilot-operated check valve (not shown) may result in jerky motion and can cause a runaway condition when opening the valve after stopping.

An embodiment of the present invention as is depicted in the views of FIGS. 1-4C, is directed to a valve 10 having three valves 20, 30, 40 in one body 12. First, and as may be seen, a counterbalance valve 20 supplies a continuous pressure to balance a Load on a cylinder 14 (see FIGS. 4A-4C). The counterbalance valve 20 may be adjusted to maintain the Load in an elevated position by applying constant back pressure to the air cylinder 14. Second, a pilot-operated check valve 30 (See FIG. 2B, for example) traps air pressure on the opposite side of the air cylinder 14, to thereby reduce cylinder 14 bounce. Third, a 3-way valve 40 quickly exhausts the pilot supply to the counterbalance valve 20, so that any movement due to Load momentum does not further increase the pressure on the counterbalance valve 20, causing it to open, and the cylinder 14 to drift until the system stabilizes.

When lowering the Load, very little pressure is required, because the Load tends to move the cylinder 14 due to gravity. The effect of gravity may be a problem with known pilot-operated check valves (not shown), because known devices require a minimum pilot pressure to open the valve. Since the line to lower the cylinder requires very little pressure, the pressure may drop below the required minimum valve operating pressure, causing the Load to bounce undesirably as it moves downward.

The counterbalance valve 20 of the present arrangement increases the pilot pressure by applying back pressure to the cylinder 14 that will increase the pressure required to lower the Load, and therefore, increase the pilot pressure, by providing a constant resistance to the cylinder 14.

The counterbalance valve 20 also reduces the chances of a runaway condition that may occur when the cylinder 14 is stopped, and then restarted without any back pressure on the cylinder 14. The counterbalance valve 20 typically applies resistance to motion, so there is no sudden surge in motion. The runaway condition may occur if a typical dual check valve (not shown) is used instead of a counterbalance valve 20 and check valve 30 combination of the present invention. Likewise, a typical dual check valve (not shown) may quickly exhaust any back pressure on the cylinder 14, allowing it to undesirably surge forward.

The present valve 10 may further include a 3-way valve 40 to further reduce undesirable drift due to load momentum. When the system stops, the Load tends to stay in motion causing the air cylinder 14 to compress the air, thereby increasing the air pressure on the counterbalance valve 20, causing it to stay open, until the system equalizes. The 3-way valve 40 greatly reduces this effect by closing the internal piston 42 that opens the counterbalance valve 20, so that a surge in air pressure cannot continue to open the counterbalance valve 20 and cause the Load to drift. It is to be understood that while the present invention greatly reduces the amount of drift, a small amount of drift will always occur, due to the compressibility of air.

II. Operation of the Counterbalance/3-way and Check Valve

Figure 4A:
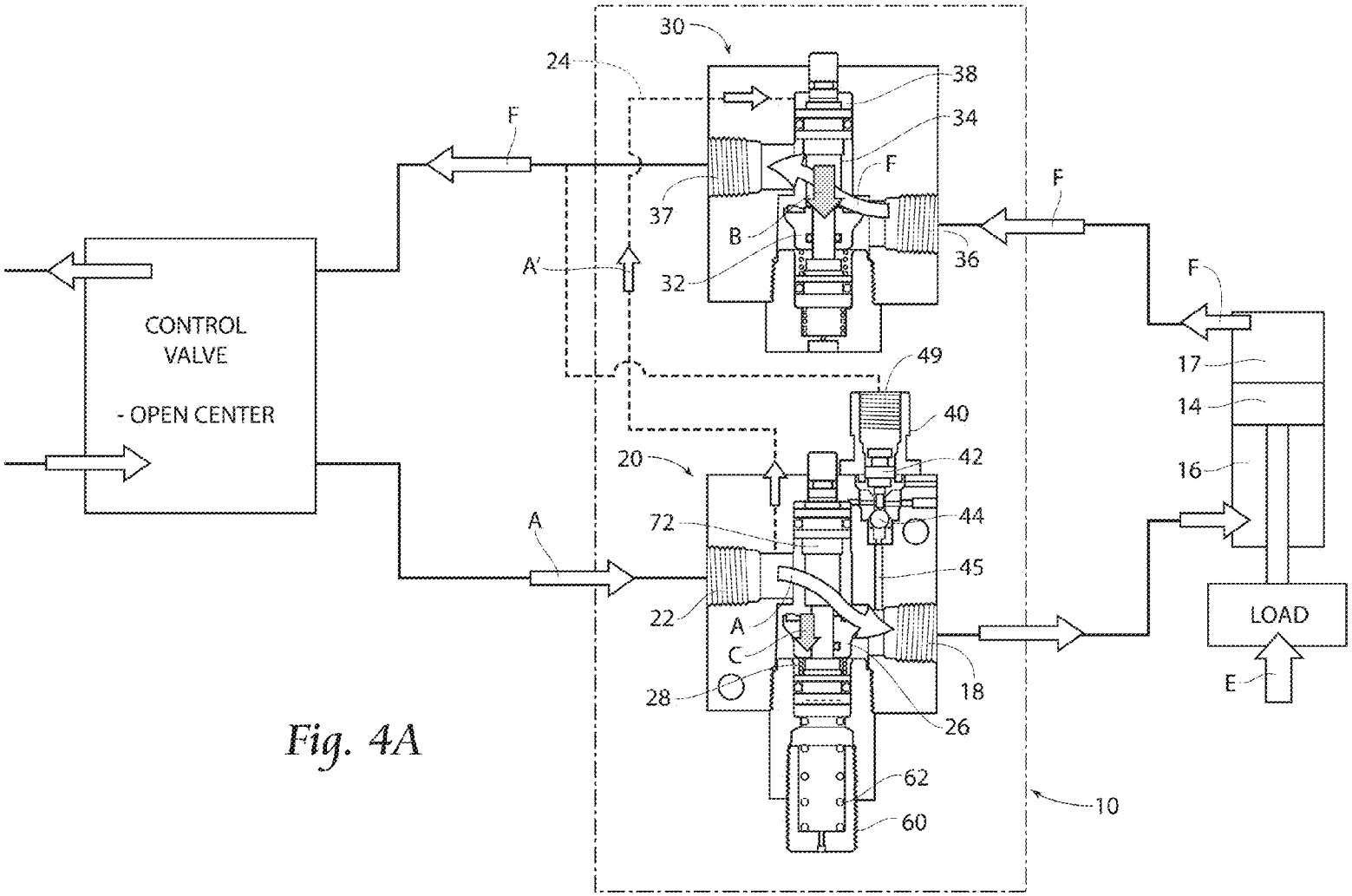
FIGS. 4A-4D are graphic representations of a fluid flow system according to the present invention using the valve illustrated in FIGS. 1-3 and showing use thereof.
Figure 4B:
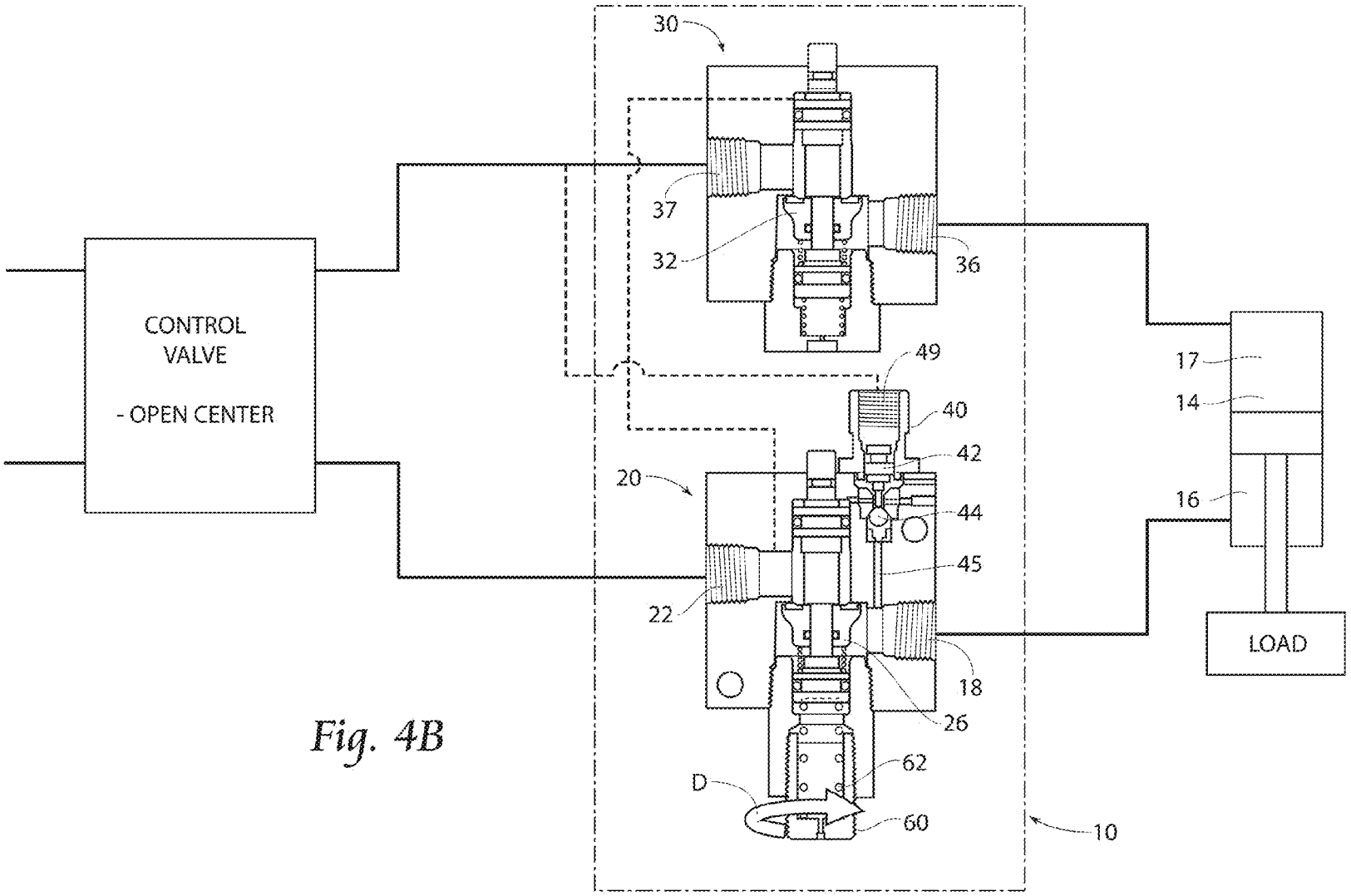
Figure 4C:
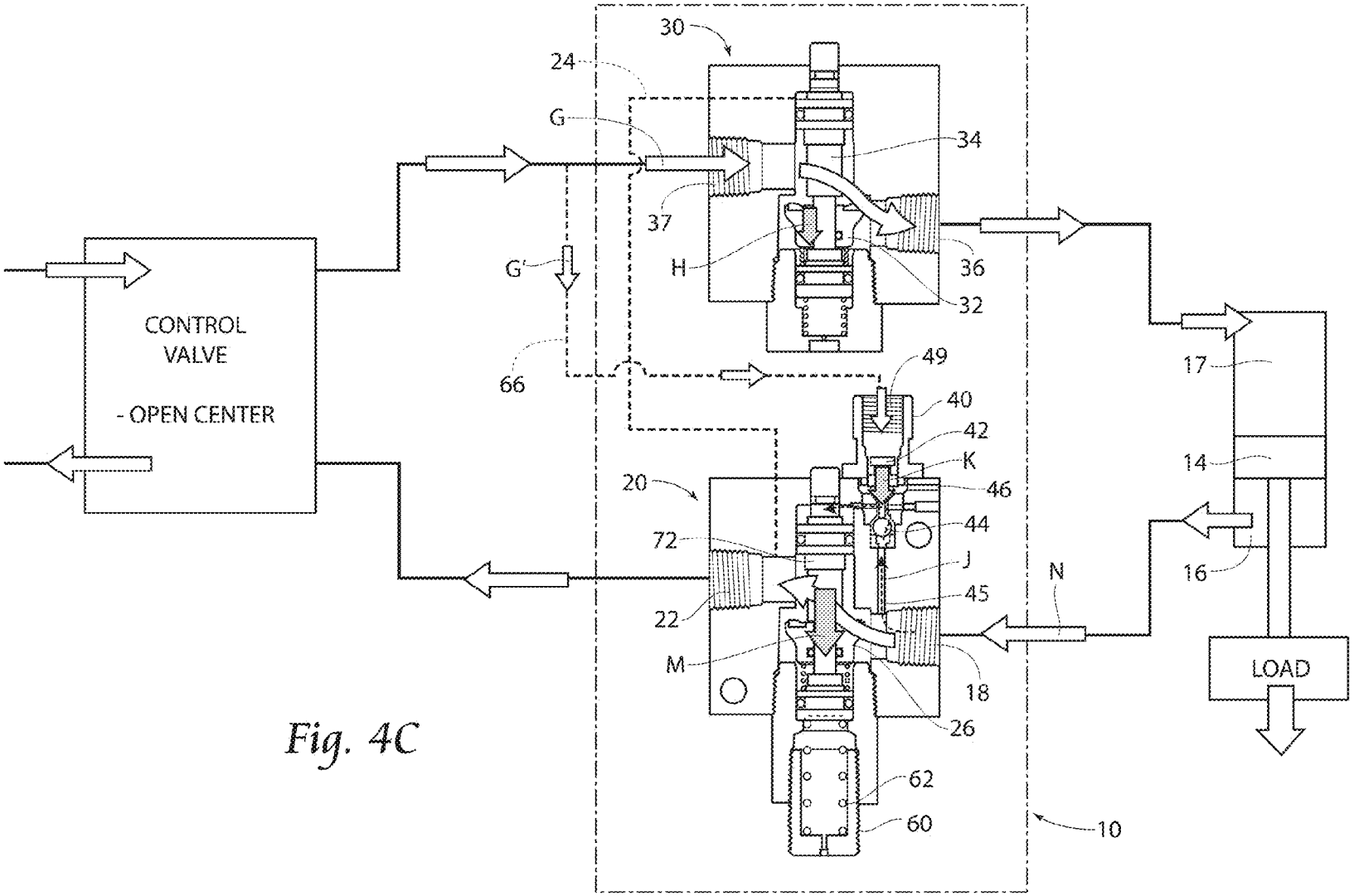

Operation of the combination counterbalance/3-way and check valve 10 illustrated in FIGS. 1-4C may be particularly seen in the views of FIGS. 4A-4C. As shown particularly in FIG. 4A, air pressure from a supply source (not shown) is connected to a control valve. When the control valve is energized to advance an air cylinder 14, the air enters the control valve and the input port 22 of the counterbalance valve 20 in the direction of arrow A. The air further flows in the direction of arrow A' via the air line 24, to the main seat 32, on the check valve 30, by shifting the cartridge spool 34 in the pilot bore 38 in the direction of arrow B (See also FIG. 2B). As shown in FIG. 2B, the cartridge spool 34 is biased by spring 64 and is located between two balancing pistons 54A, 54B, with the pistons 54A, 54B being connected on a shaft 56. Air enters the counterbalance valve 20 input port 22 in the direction of arrow A and opens the counterbalance main seat 26 by moving it in the direction of arrow C. The counterbalance main seat 26 is lightly biased by seat spring 28 (see particularly FIG. 2A). The air continues to pass through the counterbalance main seat 26 in the direction of arrow A to the counterbalance valve output port 18, thereby supplying air to the rod side 16, of the air cylinder 14 and raising the Load in the direction of arrow E. The ball check 44 in the 3-way valve 40 is closed, so air cannot escape through air passage 45.

With further attention to FIG. 4A, as the air cylinder 14 lifts the Load, air escapes from the cap side 17 of the air cylinder 14 in the direction of arrow F, and through the output port 36 of the check valve 30 in the direction of arrow F, out the main seat 32 of the check valve 30. As previously mentioned, the main seat 32 of the check valve 30 will be open since air pressure is supplied by the air line 24, to the check valve pilot bore 38. Air escapes out the inlet port 37 of the check valve 30 in the direction of arrow F and through the control valve.

With reference to FIG. 4B, it may be seen that when the control valve is in the neutral, stopped position, an adjusting screw 60 may be set to hold the Load in position. The adjusting screw 60 is turned clockwise in the direction of arrow D to compress a spring 62. The spring 62 thereby biases the main seat 26 to close the outlet port 18. The screw is turned until the back pressure on the air cylinder 14, holds the Load in a suspended position.

Figure 4D:
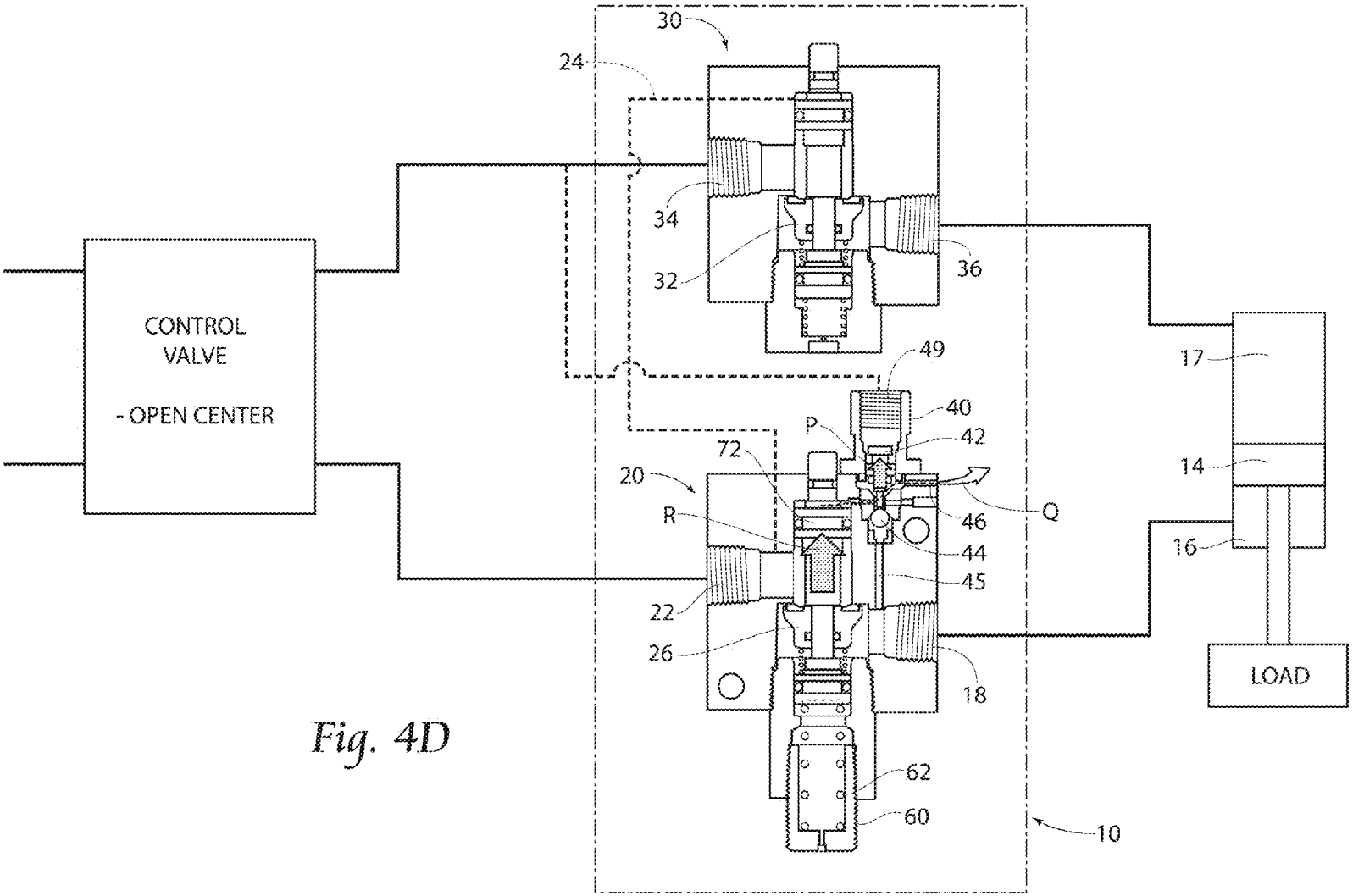

Turning now to FIGS. 4C and 4D, a method to reverse direction, or lower the Load utilizing the present valve 10 may be seen. As illustrated, the control valve supplies air to the input port 37 of the check valve 30 in the direction of arrow G, causing the main seat 32 to open in the direction of arrow H. The main seat 32 is lightly biased closed by a poppet spring 64. Air is also supplied to the 3-way valve 40, via air line 66 in the direction of arrow G', which causes the piston 42 of the 3-way valve 40 to move downward in the direction of arrow K. Air line 66 usually taps into inlet port 37 of the check valve 30, but may also be connected to another source of air pressure where the air is able to exhaust more quickly. The seal 48 on the piston. 42 closes the air passage 70 from the pilot bore 68 of counterbalance valve 20 to the exhaust passage 46 (see particularly FIG. 2C). The piston 42 also unseats the ball check 44, and opens the air passage 45, to the pilot bore 68 to allow air to flow in the direction of arrow J. The pressure shifts the cartridge spool 72 in the direction of arrow N to open the main seat 26 (see particularly FIG. 2A), causing air to flow in the direction of arrow N to a pressure differential required to hold the Load in position.

With particular attention to FIG. 4D, when the control valve is in the center position both ports 22 and 37 exhaust, and the pressure at the 3-way port 49, drops to zero. At the same time, spring 50 (see FIG. 2C) of the 3-way valve 40 pushes the piston 42 away from the ball check 44 in the direction of arrow P, and spring 52 biases ball check 44 to close. Air passage 45 closes and the air passage 70 from the pilot bore 68 opens to atmosphere, exhausting through the exhaust passage 46 in the direction of arrow Q. It is to be understood that spring 50 may be replaced with various springs under differing tensions if back pressure so requires and if the valve 10 is required to close at a faster rate.

The loss of pressure in pilot bore 66 causes the spring 62 to shift the cartridge spool 72 of the counterbalance valve 20 in the direction of arrow R and to close the main seat 26. The 3-way valve 40 closes air passage 45, so that any increase in pressure due to load momentum, will not open the counterbalance valve 20, causing the air cylinder 14 to drift after stopping.

III. Counterbalance/3-Way and Counterbalance/3-Way Valve

With specific reference to FIGS. 5-8B, another embodiment valve 100 according to the present invention may be seen. The valve configuration described and illustrated in these views is preferably used in applications requiring high cylinder pressure in two directions of motion. An example of such an application is a heavy load application in which movement in two directions is required and drift due to momentum needs to be minimized in both directions.

An embodiment of the present invention for use in such applications is depicted in the views of FIGS. 5-8B. As seen, the valve 100 includes four valves 20, 20A, 40, 40A in one body 12. A counterbalance valve 20, 20A is applied during both cylinder 14 motions due to the effects of both gravity and momentum in both the elevating and lowering directions. Both counterbalance valves 20, 20A may be adjusted for varying back pressures, depending on load and motion, as will be discussed.

A 3-way valve 40, 40A is also applied in both cylinder directions, to thereby reduce the amount of drift after stopping the cylinder 14. As in the previous embodiment, the 3-way valve 40, 40A quickly exhausts the pilot supply to the counterbalance valve 20, 20A, so that any movement due to load momentum does not further increase the pressure on the counterbalance valve 20, 20A causing it to open, and the cylinder 14 to drift until the system stabilizes.

In this application, the counterbalance valves 20, 20A increase the pilot pressure by applying back pressure to both sides of the cylinder 14 to increase the pressure required to both lower and raise the Load, and therefore, increase the pilot pressure, by providing a constant resistance to the cylinder 14 in either movement.

The counterbalance valves 20, 20A also reduce the chances of a runaway condition that may occur when the cylinder 14 is stopped, and then restarted without any back pressure on the cylinder 14, as described above. The counterbalance valves 20, 20A typically apply resistance to motion, so there is no sudden surge in motion.

The present valve 100 may further include two 3-way valves 40, 40A to further reduce undesirable drift due to load momentum. When the system stops, the Load tends to stay in motion causing the air cylinder 14 to compress the air, thereby increasing the air pressure on the counterbalance valve 20, 20A causing it to stay open, until the system equalizes. The 3-way valves 40, 40A greatly reduce this effect by closing the internal piston 42, 42A that opens the counterbalance valve 20, 20A so that a surge in air pressure cannot continue to open the counterbalance valve 20, 20A and cause the Load to drift. It is to be understood that while the present invention greatly reduces the amount of drift, a small amount of drift will always occur, due to the compressibility of air.

IV. Operation of the Counterbalance/3-Way and Counterbalance/3-Way Valve

Figure 5:
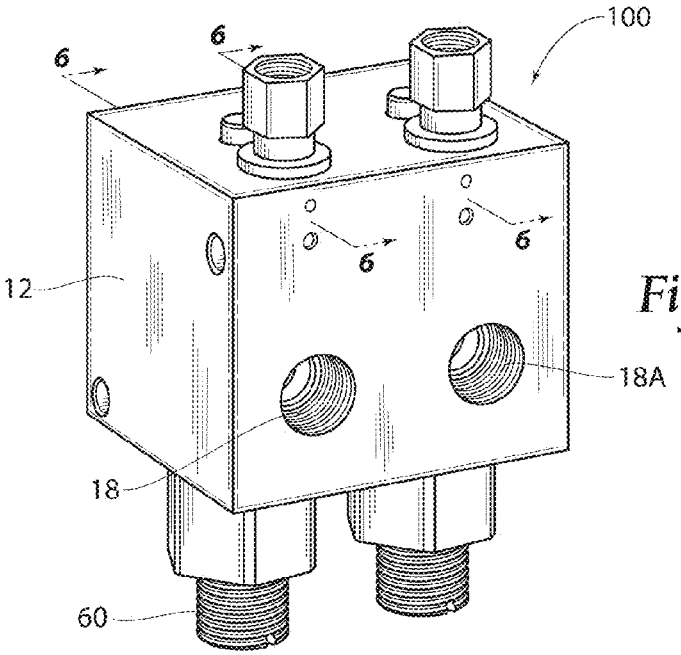
FIG. 5 is a perspective view of another embodiment of a valve for use in a fluid flow system according to the present invention.
Figure 6:
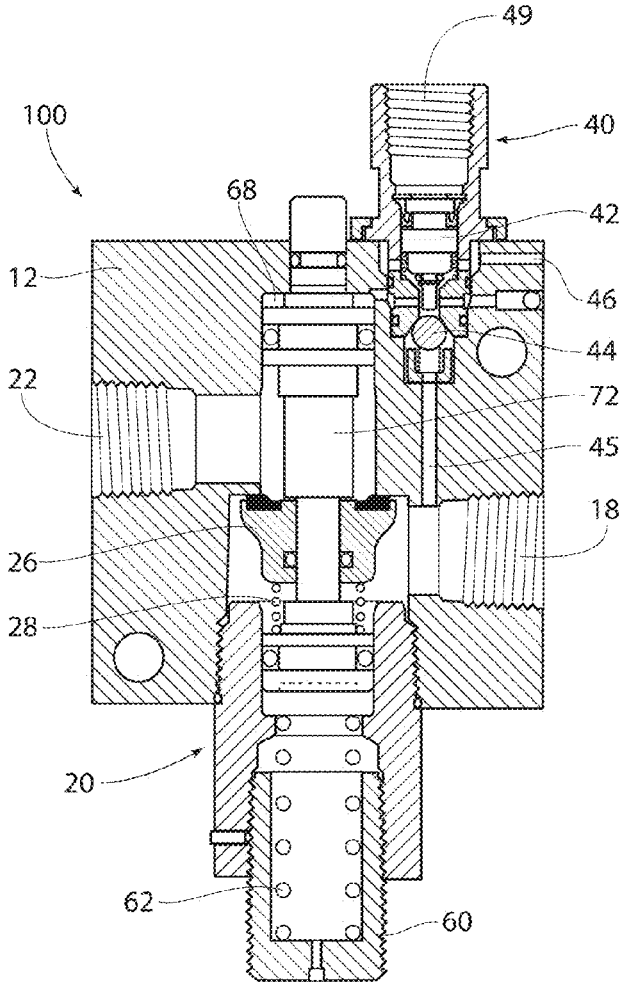
FIG. 6 is a cross sectional view of valve shown in FIG. 5 and taken along lines 6-6 thereof.
Figure 7:
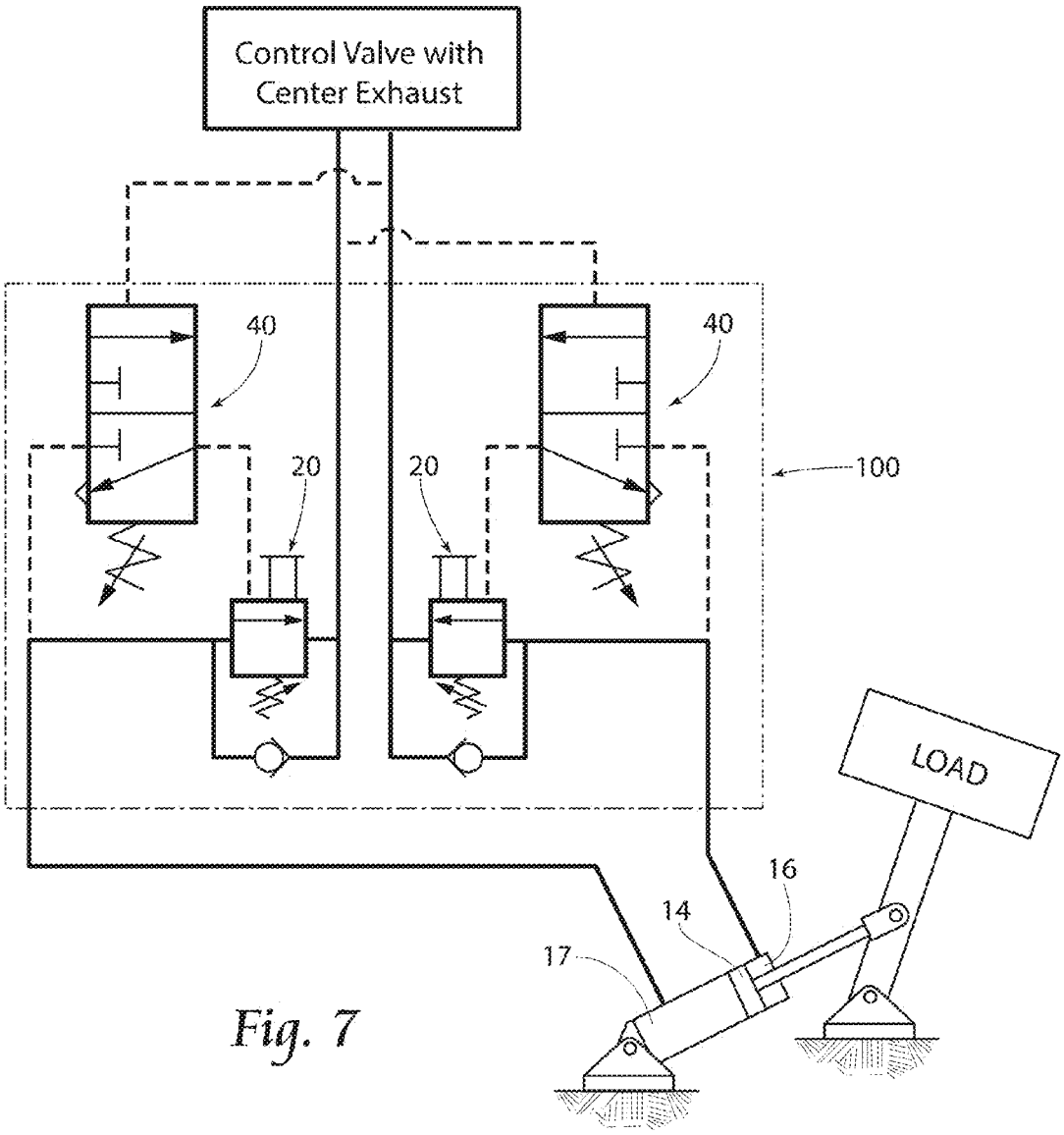
FIG. 7 is a schematic representation of the valve shown in FIG. 5 in use in a fluid flow system.
Figure 8A:
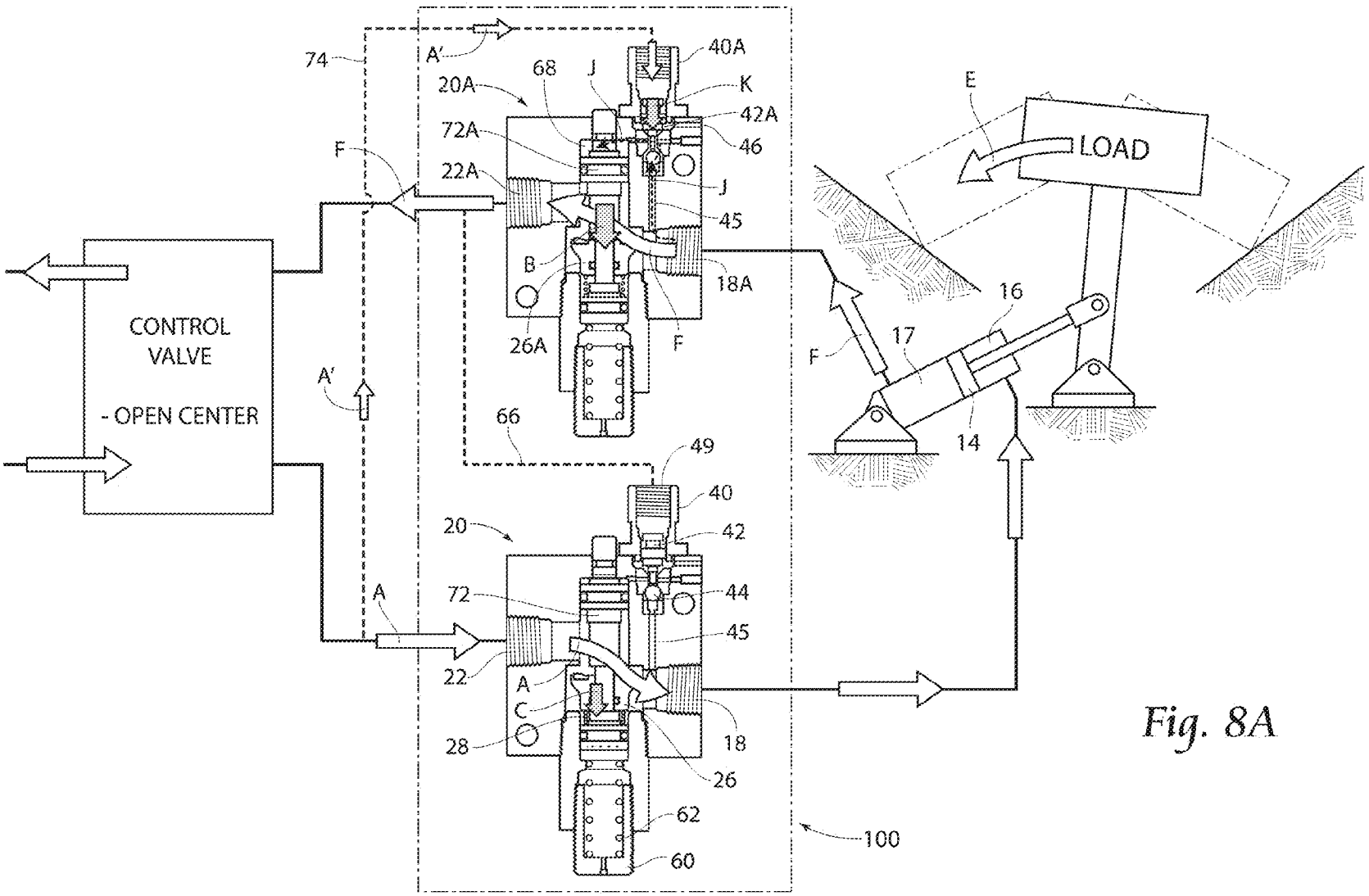
FIGS. 8A-8B are graphic representations of a fluid flow system according to the present invention using the valve illustrated in FIGS. 5-7 and showing use thereof.
Figure 8B:
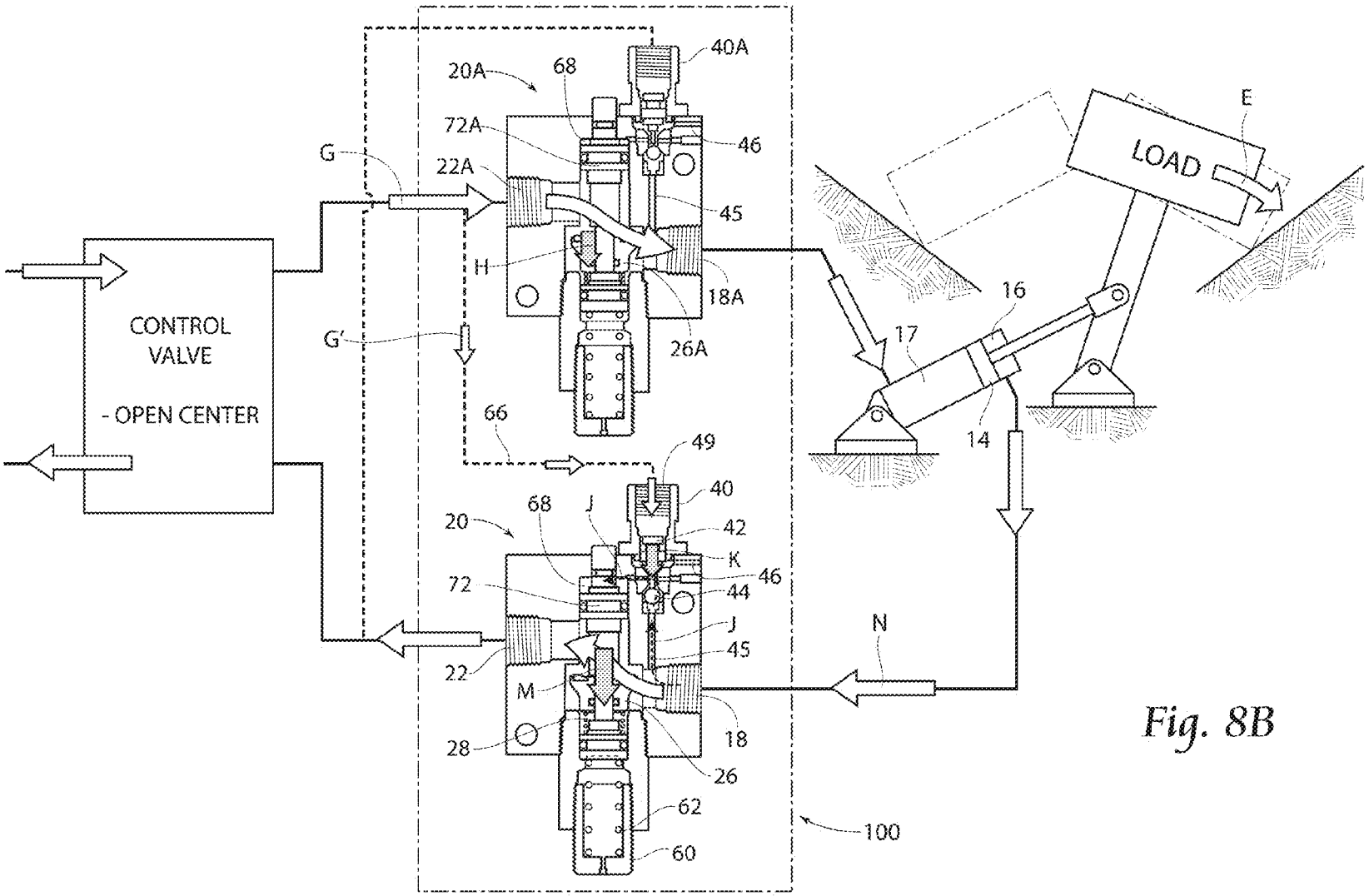

Operation of the combination counterbalance/3-way and counterbalance/3-way valve 100 illustrated in FIGS. 5-7 may be viewed particularly in FIGS. 8A-8B. With specific attention to FIG. 8A, air enters the control valve and input port 22 of counterbalance valve 20 in the direction of arrow A. The air further flows in the direction of arrow A and opens the main seat 26 of the counterbalance valve 20 by moving it in the direction of arrow C. The counterbalance main seat 26 is lightly biased by seat spring 28 (see particularly FIG. 6). The air continues to pass through the counterbalance main seat 26 in the direction of arrow A to the counterbalance valve output port 16, thereby supplying air to the rod side 16, of the air cylinder 14 and moving the Load in the direction of arrow E. The ball check 44 in the 3-way valve 40 is closed, so air cannot escape through air passage 45.

With continued attention to FIG. 8A, it may be seen that as the air cylinder 14 is moving the Load, air must be able to escape from the cap side 17, of the air cylinder 14 in the direction of arrow F. The air moves through the output port 18A of counterbalance valve 20A in the direction of arrow F, and out the main seat 26A of counterbalance valve 20A. The main seat 26A will be open because pressure supplied via air line 74, causes the piston 42A of the 3-way valve 40A to move in the direction of arrow K to unseat the ball check 44. The seal 48 on the piston 42A closes the exhaust passage 46. Air flows from air passage 45 to the pilot bore 68 in the direction of arrow J. The increase in air pressure will cause the cartridge spool 72A to shift in the direction of arrow B and to open the main seat 260. Air may now escape through outlet port 22A in the direction of arrow F and exhaust through the control valve.

As in the previous embodiment, when the control valve is in the neutral, stopped position, an adjusting screw 60 may be set to hold the Load in position. The adjusting screw 60 is turned clockwise in the direction of arrow D to compress a spring 62 (see FIG. 4B). The spring 62 thereby biases the main seat 26 or 26A to close the outlet port 18 or 18A. The screw is turned until the back pressure on the air cylinder 14 holds the Load in a suspended position.

When the control valve is in the center position both ports 22 and 22A exhaust, and the pressure at the port 49 of 3-way valve 40, drops to zero. At the same time, spring 50 (see FIG. 22) of the 3-way valve 40 pushes the piston 42 away from the ball check 44 in the direction of arrow P (see FIG. 4D), and the spring 52 biases ball check 44 to close. Air passage 45 closes and the air passage 70 from the pilot bore 68 opens to atmosphere, and exhausts through the exhaust passage 46 in the direction of arrow Q. It is to be understood that spring 50 may be of any type suitable to deliver an acceptable tension and may be under differing tensions if back pressure so requires, and if the valve 100 is required to close at a faster rate. For example, higher spring rates would close the valve 100 more quickly and alleviate the effect of back pressure. An adjustable spring rate would be ideal.

With attention to FIG. 8B, a method to reverse direction or to lower the Load using valve 100 may be seen. As illustrated, the control valve supplies air to the input port 22A of counterbalance valve 20A in the direction of arrow G, causing the main seat 26A to open in the direction of arrow H. As in the discussion regarding FIG. 8A, the counterbalance main seat 26A is lightly biased by seat spring 28 (see particularly FIG. 6). The air continues to pass through the counterbalance main seat 26A in the direction of arrow G to the counterbalance valve output port 18A, thereby supplying air to the cap side 17, of the air cylinder 14 and moving the Load in the direction of arrow E. The ball check 44 in the 3-way valve 40A is closed, so air cannot escape through air passage 45.

As may be further seen in FIG. 8B, as the air cylinder 14 is moving the Load, air must be able to escape from the rod side 16, of the air cylinder 14 in the direction of arrow N. The air moves through the output port 18 of counterbalance valve 20 in the direction of arrow N, and out the main seat 26 of counterbalance valve 20. The main seat 26 will be open because pressure supplied via air line 66, causes the piston 42 of the 3-way valve 40 to move in the direction of arrow K to unseat the ball check 44. The seal 48 on the piston 42 closes the exhaust passage 46. Air flows from air passage 45 to the pilot bore 68 in the direction of arrow J. The increase in air pressure will cause the cartridge spool 72 to shift in the direction of arrow M and to open the main seat 26. Air may now escape through outlet port 22 in the direction of arrow N and exhaust through the control valve.

V. Counterbalance/3-Way and Check Valve with Flow Control

Turning now to FIGS. 9-12C, another embodiment valve 200 according to the present invention may be seen. The valve configuration described and illustrated in these views is preferably used in applications requiring movement of heavy load in one direction, and drift due to momentum needs to be minimized in one direction. In situations utilizing valve 200, the reverse direction requires movement of a heavy load, however drift is not as important, so a flow control is sufficient to control the movement.

An embodiment of the present invention for use in such applications is depicted in the views of FIGS. 9-12C. As seen, the valve 200 includes three valves 20, 30A, 40 in one body or block 12. A counterbalance valve 20 and 3-way valve 40 is applied to the heavy side (gravity added) and a check valve 30A having a flow control mechanism 72 is applied to the reverse motion, as will be discussed.

VI. Operation of the Counterbalance/3-Way and Check Valve with Flow Control

Figure 9:
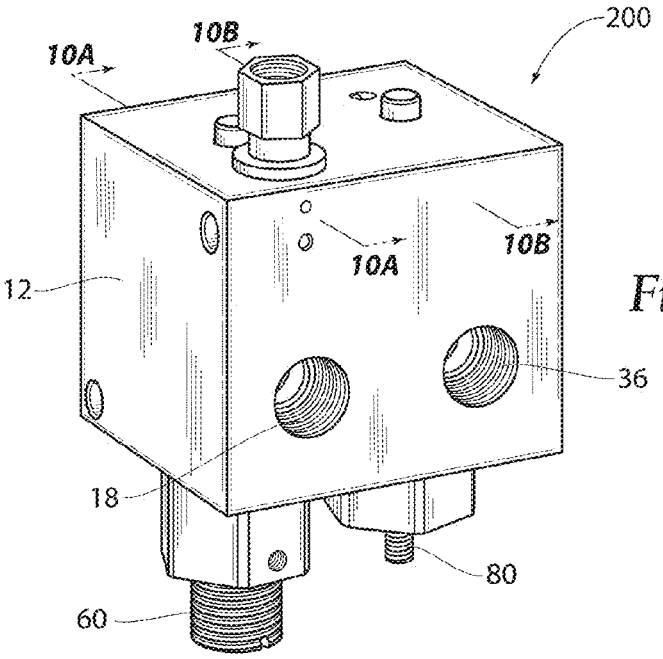
FIG. 9 is a perspective view of another embodiment of a valve for use in a fluid flow system according to the present invention.
Figure 10A:
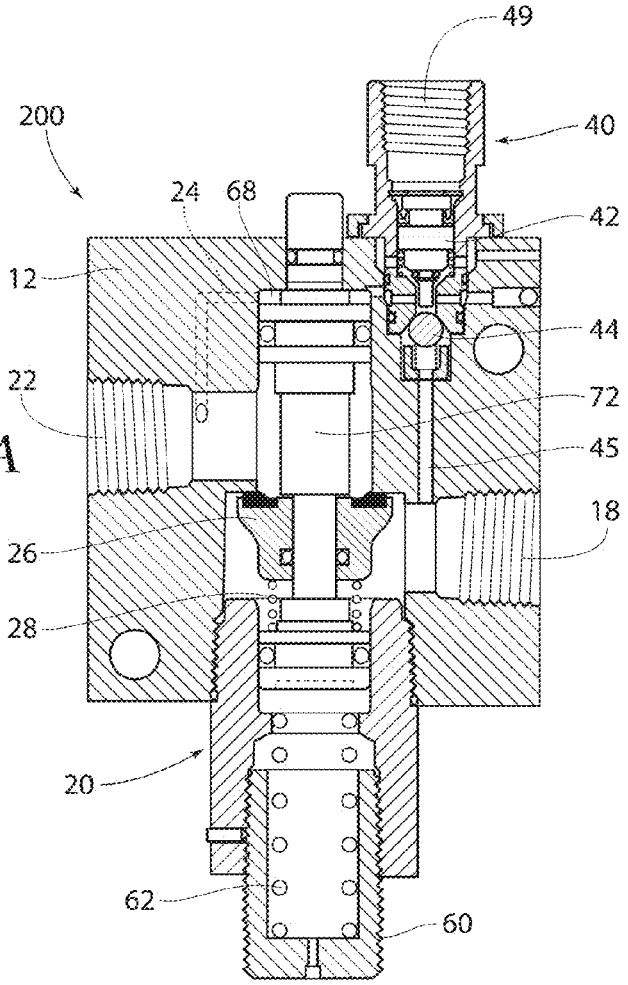
FIG. 10A is a cross sectional view of valve shown in FIG. 9 and taken along lines 10A-10A thereof.
Figure 10B:
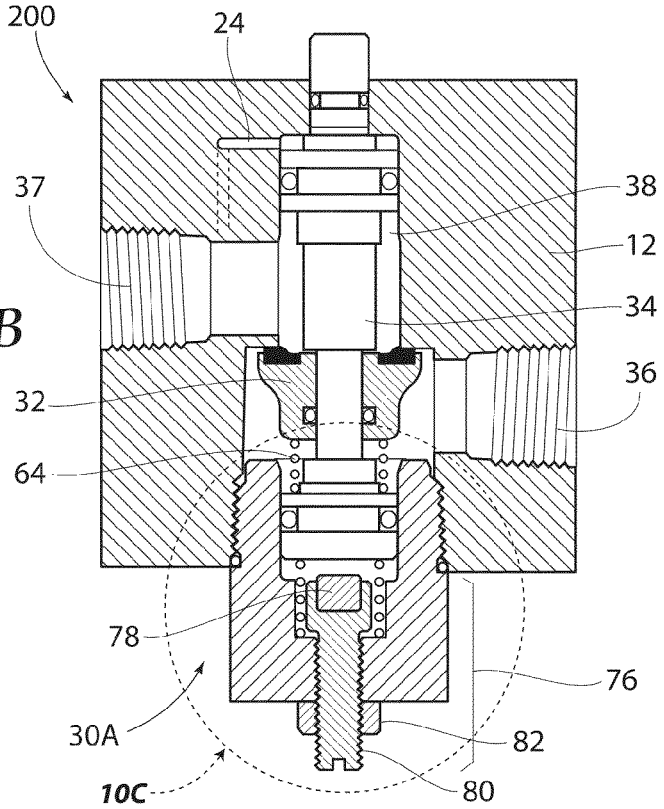
FIG. 10B is a cross sectional view of the valve shown in FIG. 9 and taken along lines 10B-10B thereof.
Figure 10C:
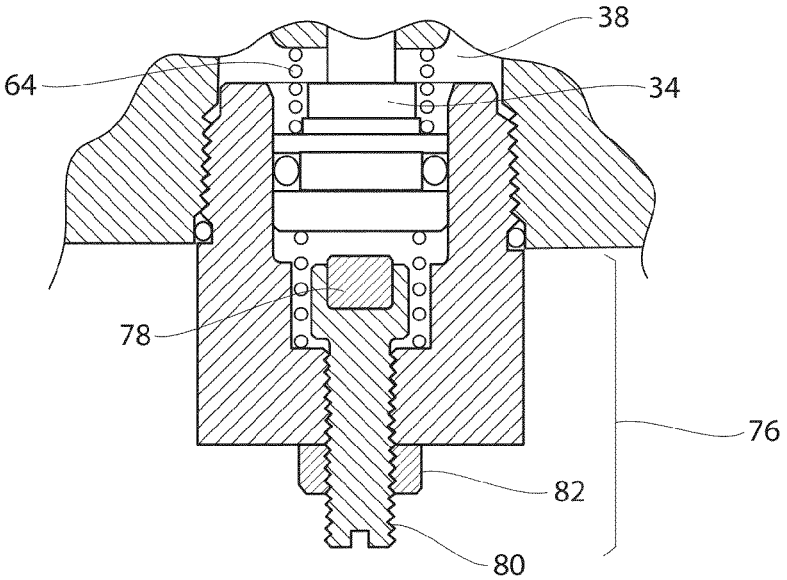
FIG. 10C is an enlarged cross sectional view of a portion of the valve shown in FIGS. 9 and 10B showing the area referenced by 10C in FIG. 10B.
Figure 11:
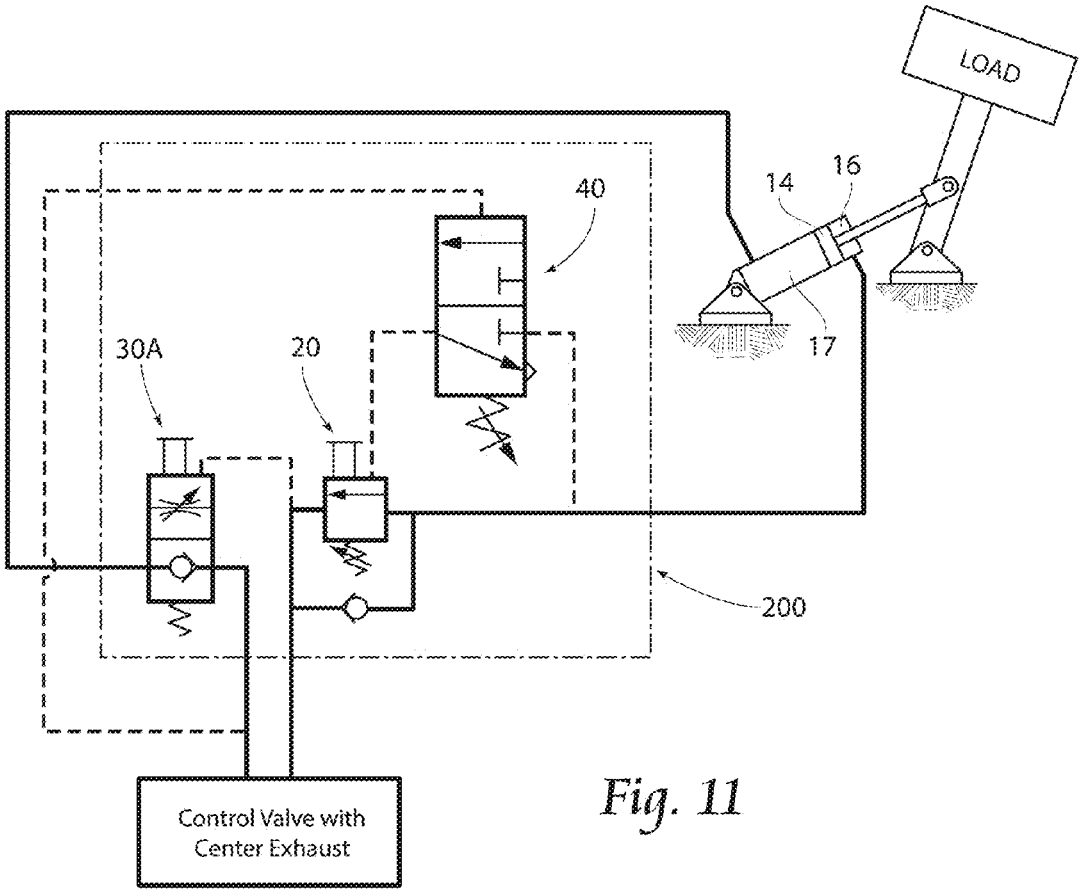
FIG. 11 is a schematic representation of the valve shown in FIG. 9 in use in a fluid flow system.
Figure 12A:
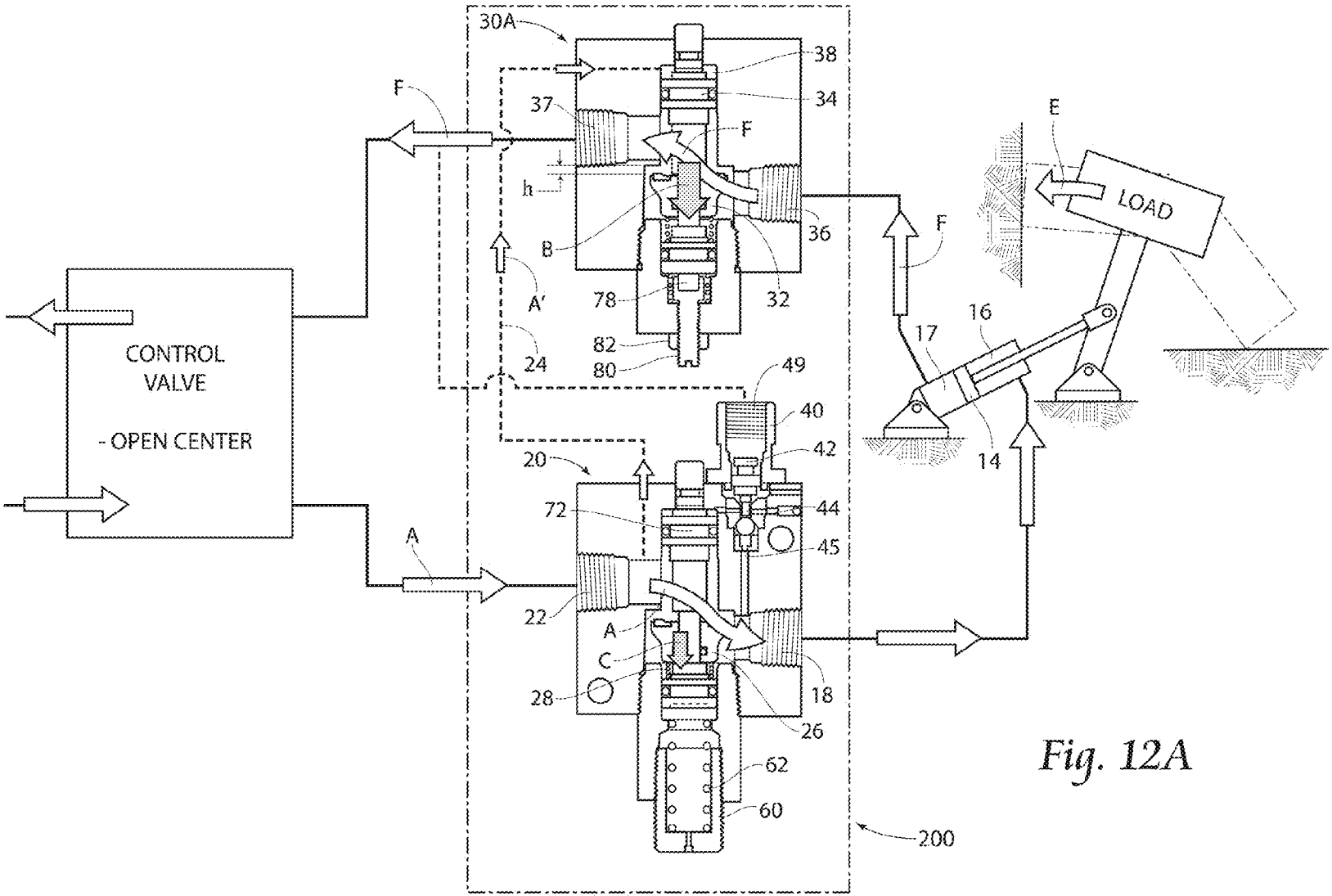
FIGS. 12A-12C are graphic representations of a fluid flow system according to the present invention using the valve illustrated in FIGS. 9-11 and showing use thereof.
Figure 12B:
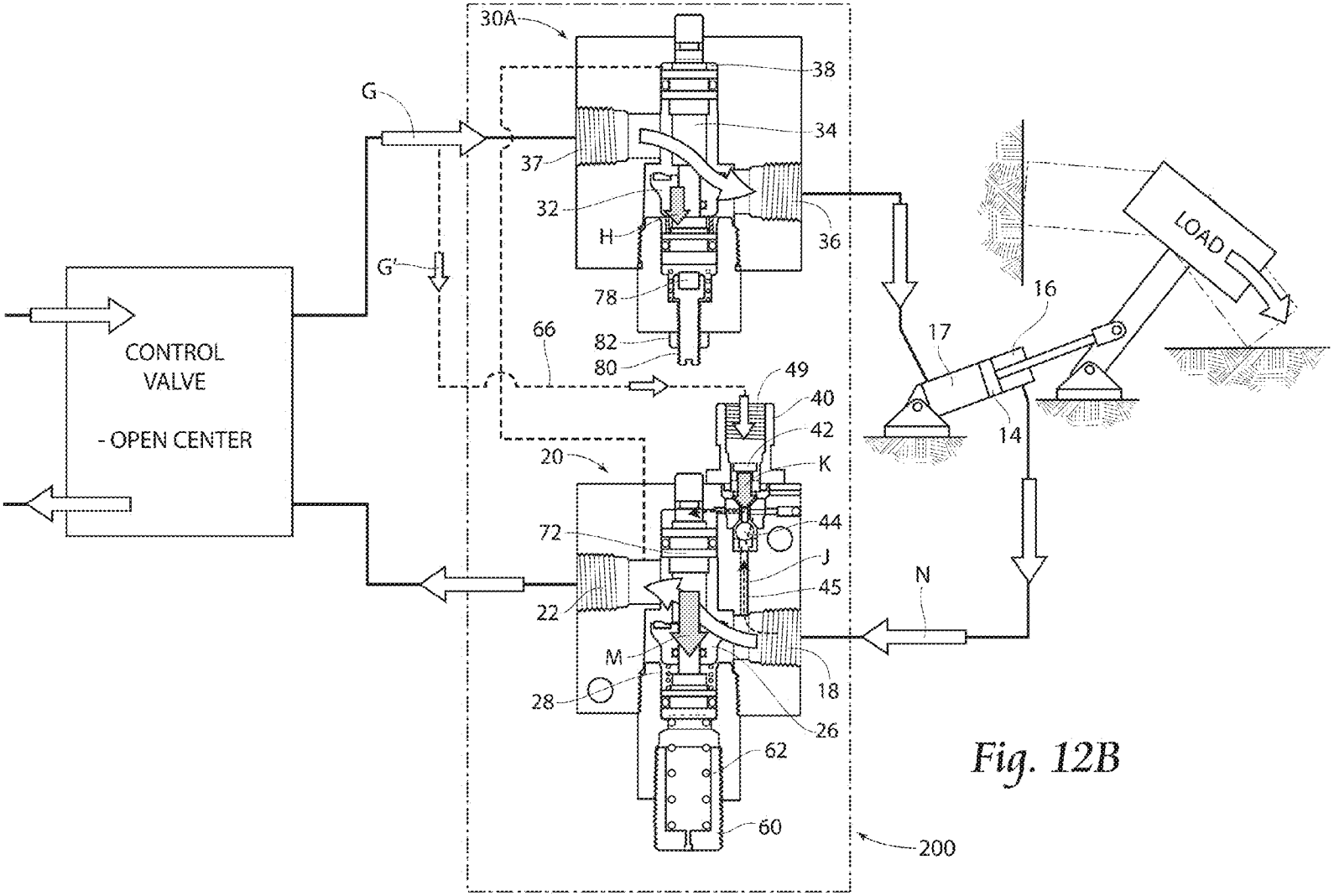
Figure 12C:
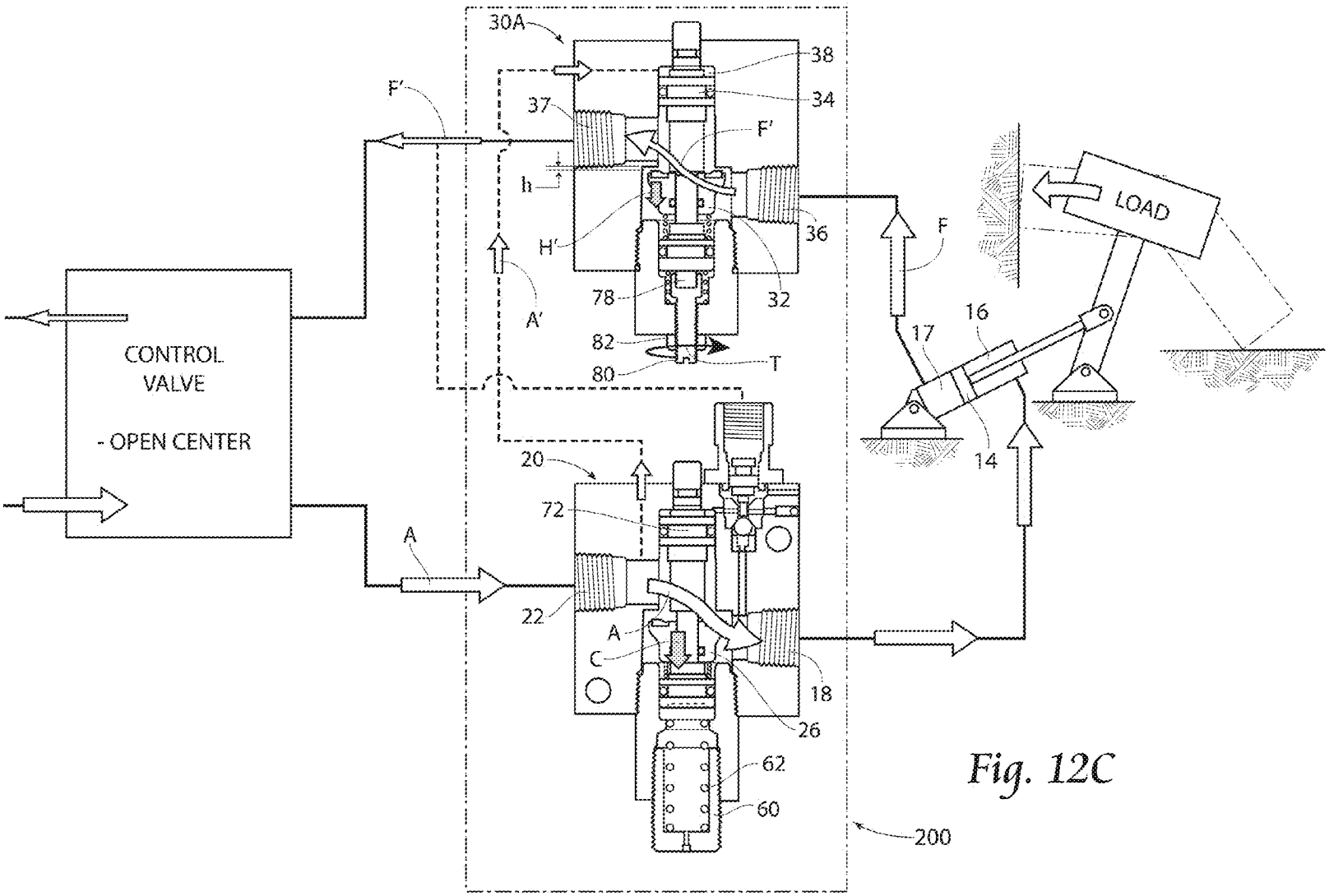

Operation of the combination counterbalance/3-way and check valve with flow control 200 illustrated in FIGS. 9-11 may be seen in the views of FIGS. 12A-12C. With specific attention to FIG. 12A, air enters the control valve and the input port 22 of counterbalance valve 20 in the direction of arrow A. The air further flows in the direction of arrow A' via air line 24, to the main seat 32, on check valve 30A, by shifting the cartridge spool 34 in the pilot bore 38 in the direction of arrow B. Movement of the cartridge spool 34 is limited a flow control mechanism 76. Specifically, the flow control mechanism 76 includes a bumper 78 (see FIGS. 10B and 10C) attached to an adjusting screw 80 which can be set to vary the travel of the cartridge spool 34, and thus, vary the height h that the main seat 32 opens and thereby control flow (see FIGS. 12A and 12C). A locking nut 82 holds the adjusting screw 80 in position.

Air enters the counterbalance valve 20 input port 22 in the direction of arrow A and opens the counterbalance main seat 26 by moving it in the direction of arrow C. The counterbalance main seat 26 is lightly biased by seat spring 28 (see particularly FIG. 2A). The air continues to pass through the counterbalance main seat 26 in the direction of arrow A to the counterbalance valve output port 18, thereby supplying air to the rod side 16, of the air cylinder 14 and moving the Load in the direction of arrow E. The ball check 44 in the 3-way valve 40 is closed, so air cannot escape through air passage 45.

With further attention to FIG. 12A, as the air cylinder 14 moves the Load, air must escape from the cap side 17 of the air cylinder 14 in the direction of arrow F, through the output port 36 of the check valve 30A, and out the main seat 32, of the check valve 30A. The main seat 32 will be open to a predetermined height h set by the adjusting screw 80. As illustrated in the views of FIGS. 12A and 12C, the height h can be varied to increase or restrict the flow of the air through the main seat 32 by the flow control mechanism 76. As shown in FIG. 12C, rotation of the adjustment screw 80 in the direction of arrow T positions the bumper 78 and therefore the travel boundary of the cartridge spool 34. The ability to control air flow through the main seat 32 also controls the speed of the cylinder 14 and therefore the Load movement.

As in the previous embodiments, when the control valve is in the neutral, stopped position, an adjusting screw 60 on the counterbalance valve 20 may be set to hold the Load in position. The adjusting screw 60 is turned clockwise in the direction of arrow D (see FIG. 4B) to compress a spring 62. The spring 62 thereby biases the main seat 26 to close the outlet port 18. The screw is turned until the back pressure on the air cylinder 14, holds the Load in a suspended position.

Also similar to the embodiment illustrated in FIGS. 1-4D, when the control valve is in the center position both ports 22 and 37 exhaust, and the pressure at the 3-way port 49, drops to zero. At the same time, spring 50 (see FIG. 2C) pushes the piston 42 away from the ball check 44 in the direction of arrow P, and spring 52 biases the ball check 44 to close. Air passage 45 closes and the air passage 70 from the pilot bore 68 opens to atmosphere, exhausting through exhaust passage 46 in the direction of arrow Q (see FIG. 4D). It is to be understood that spring 50 may be of any type suitable to deliver an acceptable tension and may be under differing tensions if back pressure so requires, and if the valve 200 is required to close at a faster rate. For example, higher spring rates would close the valve 200 more quickly and alleviate the effect of back pressure. As in the previous embodiments, an adjustable spring rate would be ideal.

Turning now to FIG. 12B, a method to reverse direction, or lower the Load utilizing the valve 200 may be seen. As illustrated, the control valve supplies air to the input port 37 of the check valve 30A in the direction of arrow G, causing the main seat 32 to open in the direction of arrow H. The main seats 32 is lightly biased closed by a poppet spring 64 (see FIG. 10B). Air is also supplied to the 3-way valve 40, via air line 66 in the direction of arrow G', which causes the piston 42 of the 3-way valve 40 to move downward in the direction of arrow K. The seal 48 on the piston 42 closes the air passage 70 from the pilot bore 68 of counterbalance valve 20 to the exhaust passage 46 (see particularly FIG. 2C). The piston 42 also unseats tie ball check 44, and opens the air passage 45, to the pilot bore 68 to allow air to flow in the direction of arrow J. The pressure shifts the cartridge spool 72 in the direction of arrow M to open the main seat 26 (see particularly FIG. 2A), causing air to flow in the direction of arrow N to a pressure differential required to hold the Load in position.

As in previous embodiments the loss of pressure in pilot bore 68 causes the spring 62 to shift the cartridge spool 72 of the counterbalance valve 20 in the direction of arrow R and to close the main seat 26. The 3-way valve 40 closes air passage 45, so that any increase in pressure due to load momentum, will not open the counterbalance valve 20 and cause the air cylinder 14 to drift after the control valve is set to a stopped, neutral position.

VII. Counterbalance and Check with Flow Control Valve

With reference now to FIGS. 13-16B, another embodiment valve 300 according to the present invention may be seen. The valve configuration described and illustrated in these views is preferably used in applications requiring movement of a light load in one direction and where control of drift due to momentum is not required. In this application, movement in the reverse direction also does not require drift control, therefore use of a flow control mechanism is sufficient to control movement.

Figure 13:
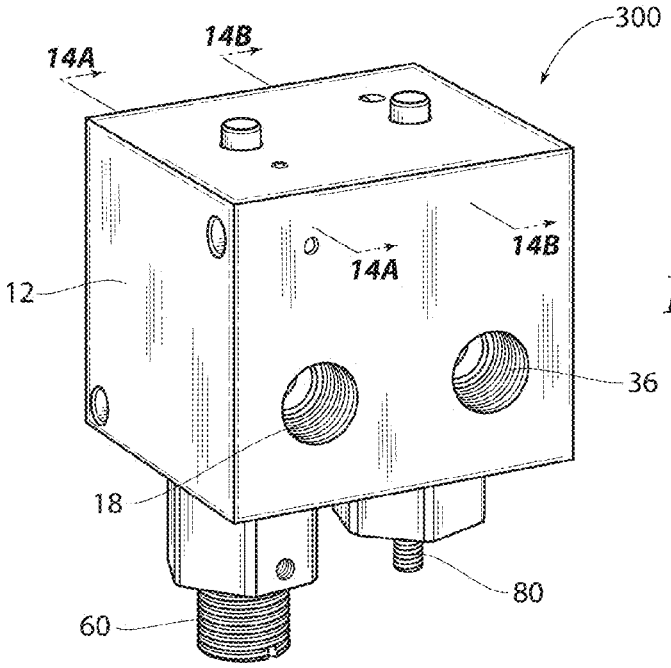
FIG. 13 is a perspective view of another embodiment of a valve for use in a fluid flow system according to the present invention.
Figure 14A:
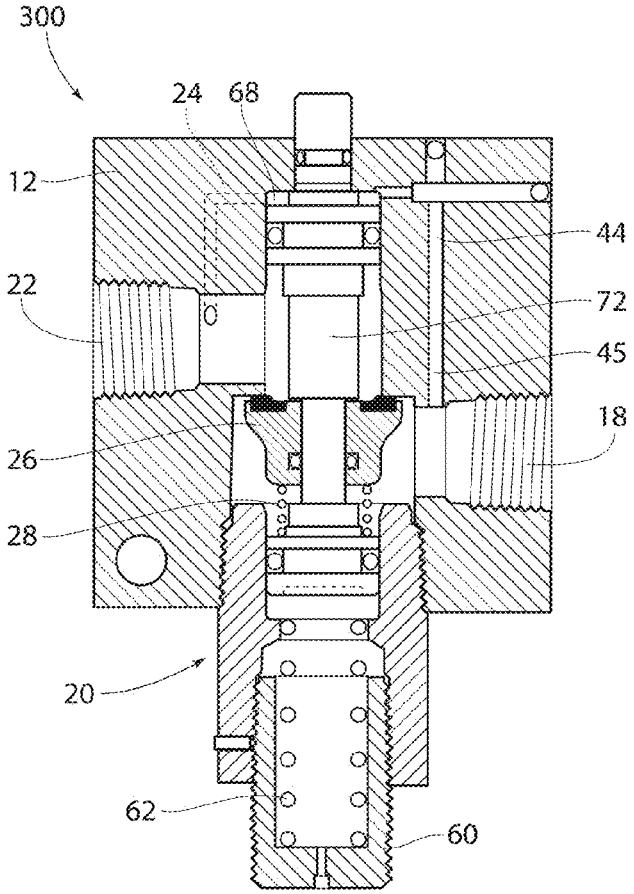
FIG. 14A is a cross sectional view of valve shown in FIG. 13 and taken along lines 14A-14A thereof.
Figure 14B:
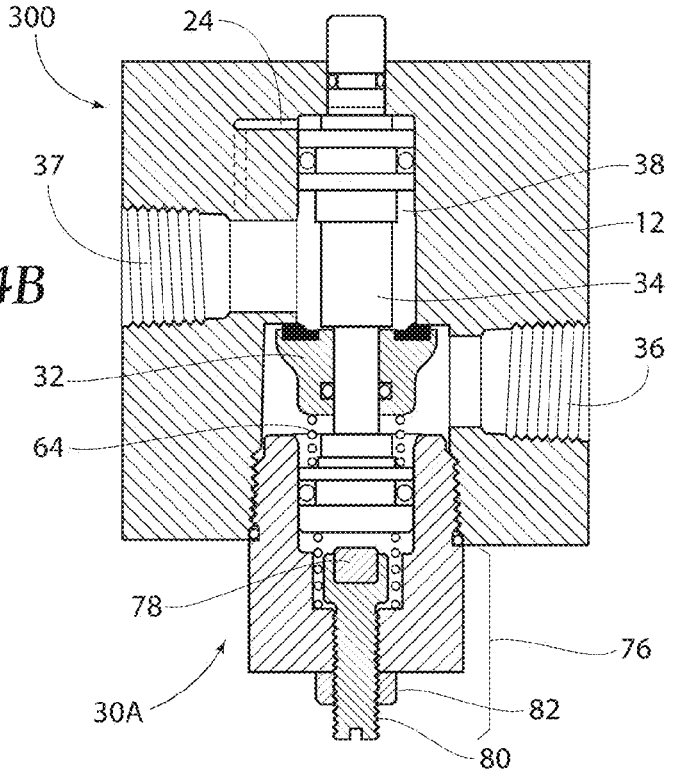
FIG. 14B is a cross sectional view of the valve shown in FIG. 13 and taken along lines 14B-14B thereof.
Figure 15:
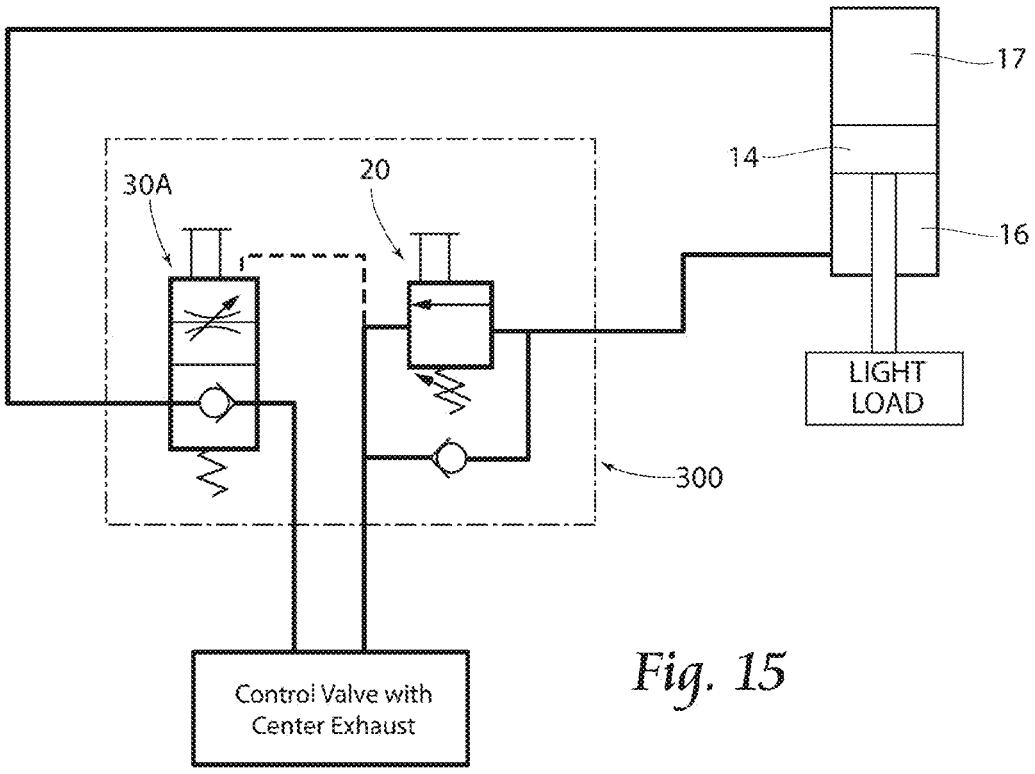
FIG. 15 is a schematic representation of the valve shown in FIG. 13 in use in a fluid flow system.

An embodiment of a valve for use in such applications may be seen in the views of FIGS. 13-14B. As illustrated, the valve 300 includes two valves 20, 30A in one block or body 12. A counterbalance valve 20 is applied during lifting of the Load to the cylinder 14 side where the force of gravity adds to the pressure. A flow control mechanism 76 on the check valve 30A is applied during reverse motion of the Load to regulate motion.

VIII. Operation of the Counterbalance and Flow Control Valve

Figure 16A:
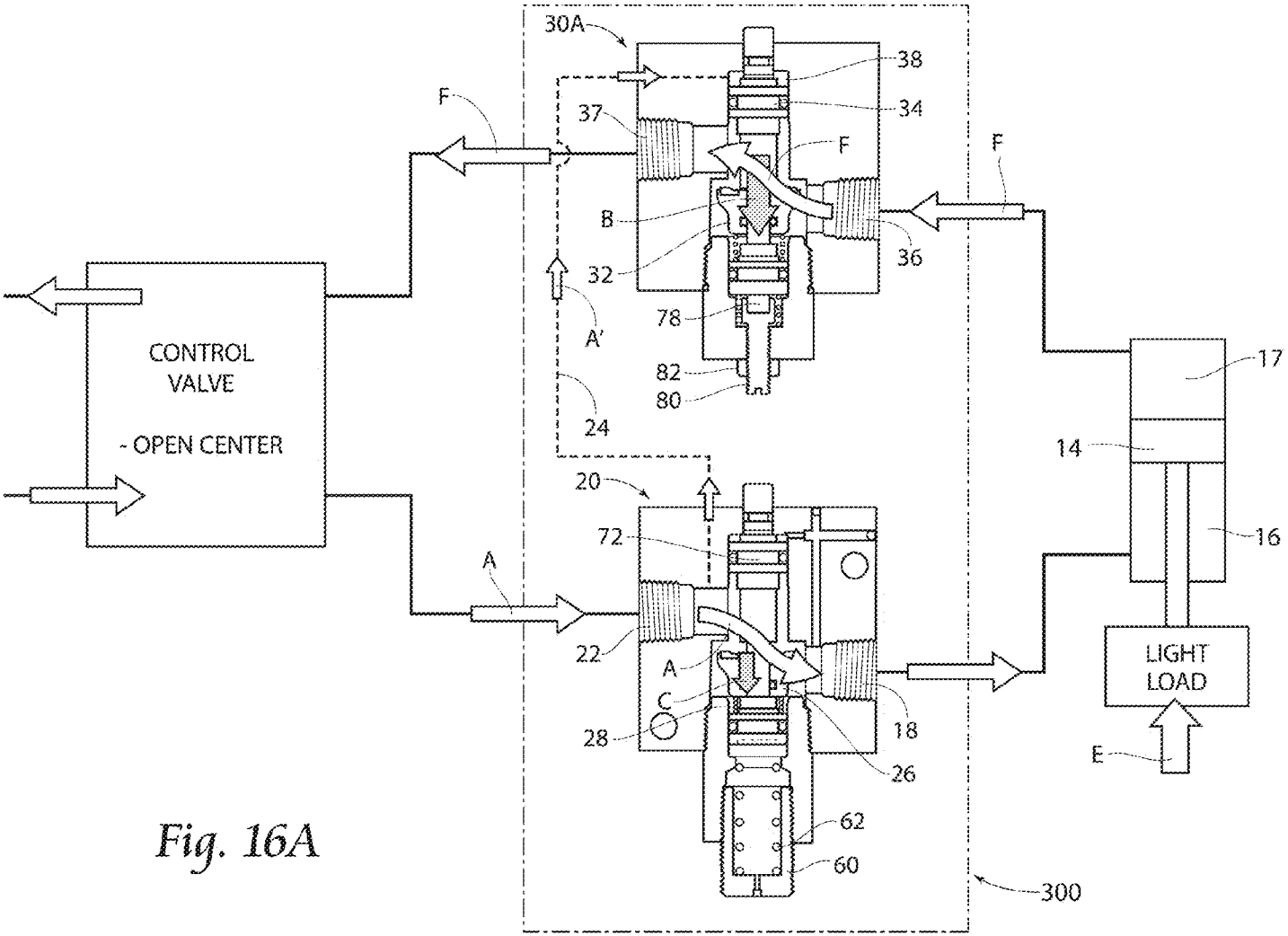
FIGS. 16A-16B are graphic representations of a fluid flow system according to the present invention using the valve illustrated in FIGS. 13-15 and showing use thereof.
Figure 16B:
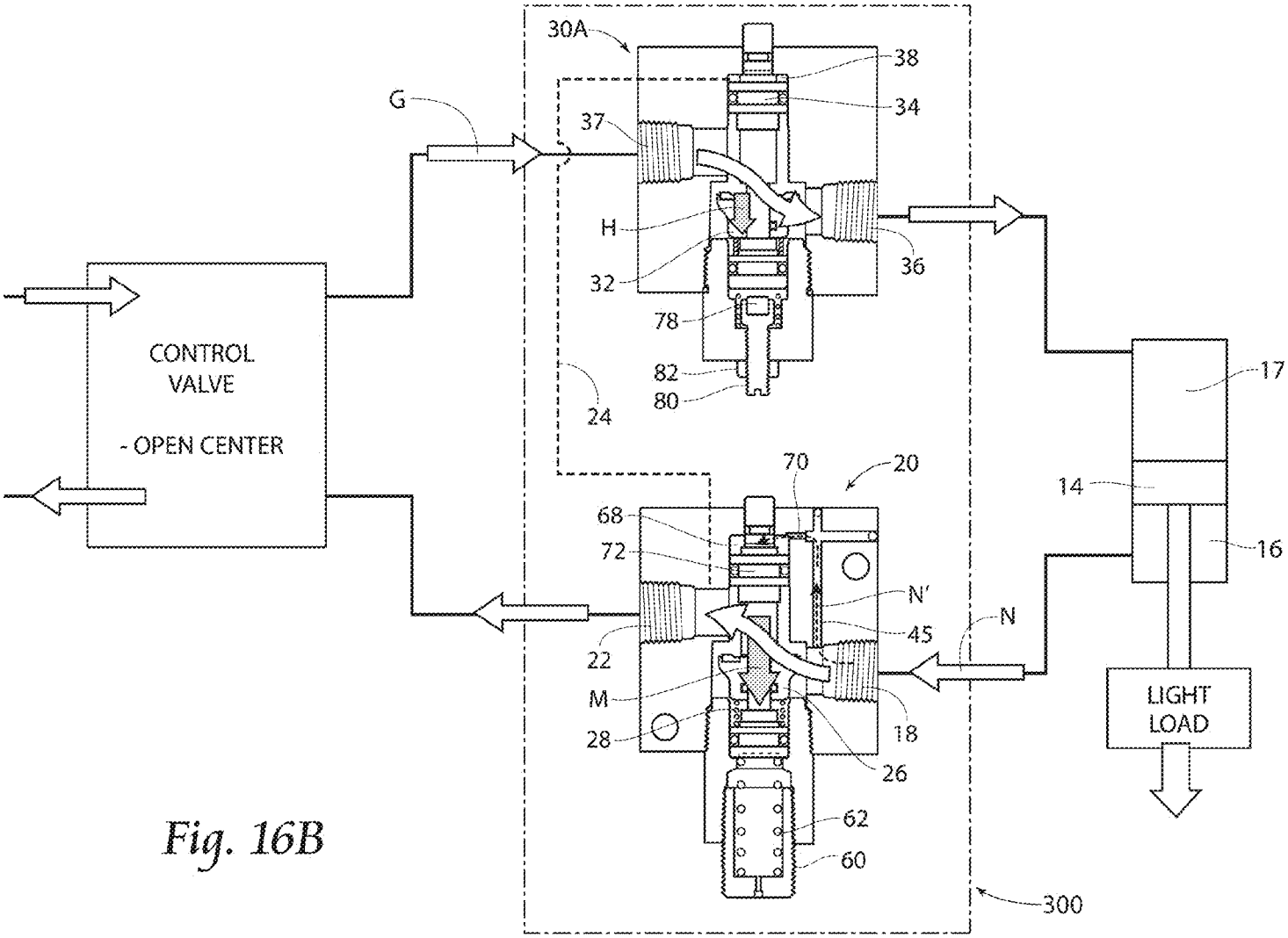

Operation of the Counterbalance and Flow Control Valve 300 may be seen in the views of FIGS. 16A and 16B. As is shown in FIG. 16A, air enters the control valve and the input port 22 of the counterbalance valve 20 in the direction of arrow A. The air further flows in the direction arrow A' via the air line 24, to the main seat 32, on the check valve 30A, by shifting the cartridge spool 34 in the pilot bore 38 in the direction of arrow B. Movement of the cartridge spool 34 is limited by a flow control mechanism 76. Specifically, and similar to the embodiment illustrated in FIGS. 9-12C, the flow control mechanism 76 includes a bumper 78 (see FIG. 14B) attached to an adjusting screw 80. The movement of the cartridge spool 34 is limited by the bumper 78 attached to the adjusting screw 80 which can be set to vary the travel of the cartridge spool 34, and thus, vary the height h that the main seat 32 opens. Turning the screw 80 clockwise in the direction of arrow T will limit the flow through the main seat 32 (see FIG. 12C). A locking nut 82 holds the adjusting screw 80 in position.

As mentioned with regard to previous embodiments, air also enters the counterbalance valve 20 input port 22 in the direction of arrow A and opens the counterbalance main seat 26 by moving it in the direction of arrow C. As in the previous embodiments, the counterbalance main seat 26 is lightly biased by seat spring 28. The air continues to pass through the counterbalance main seat 26 in the direction of arrow A to the counterbalance valve output port 18, thereby supplying air to the rod side 16, of the air cylinder 14 and moving the Load in the direction of arrow E.

With further attention to FIG. 16A, as the air cylinder 14 moves the Load, air must escape from the cap side 17 of the air cylinder 14 in the direction of arrow F, through the output port 36 of the check valve 30A, and out the main seat 32, of the check valve 30A. The main seat 32 will be open to a predetermined height h set by the adjusting screw 80. As was previously discussed with regard to FIGS. 12A and 12C, the flow control mechanism 76 may set the height h to restrict and vary the flow of the air, and therefore, limit the speed of the air cylinder 14.

When the control valve is in the neutral position (stopped), the adjusting screw 60 is turned clockwise until the back pressure on the air cylinder 14, holds the load in a suspended position.

Turning now to FIG. 16B, a method to reverse direction, or lower the Load utilizing the valve 300 may be viewed. As illustrated, the control valve supplies air to the input port 37 of the check valve 30A in the direction of arrow G, causing the main seat 32 to open in the direction of arrow H. The pressure increases in the air cylinder 14, and the cylinder 14 begins to move downward, causing the air pressure in the rod side 16 of the cylinder 14 to increase. The increased air pressure travels to the pilot bore 68, via air passages 45 and 70 in the direction of arrows N and N', respectively. The pressure overcomes the adjusting spring 62 and shifts the cartridge spool 72 in the direction of arrow M to open the main seat 26 (see particularly FIG. 2A), causing air to flow in the direction of arrow N, allowing the air to escape out port 22 to the control valve, where it will vent to atmosphere.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention.

I claim:

1. A valve comprising:

a valve body comprising:

a first pilot bore, said first pilot bore including an input bore having an input port, an output bore having an output port, and a first cartridge spool having an integral main seat said integral main seat movable along a centerline of said first cartridge spool and biased by a spring movable in a first direction to close said main seat, said first cartridge spool being disposed at least partially within said first pilot bore and biased by a cartridge spring;

a second pilot bore, said second pilot bore including an input bore having an input port, an output bore having an output port, said second pilot bore including a second cartridge spool having an integral main seat, said second cartridge spool being disposed at least partially within said second pilot bore;

said first cartridge spool including a shaft, said integral main seat being movable with respect to said shaft during operation, said shaft connecting opposing pistons, wherein said integral main seat of said first cartridge spool is located on the centerline of said first cartridge spool and between said opposing pistons, said opposing pistons being arranged to balance one another; and said second cartridge spool including opposing pistons.

2. A valve according to claim 1 wherein said valve body is a unitary member.

3. A valve according to claim 1 wherein one of said first pilot bore and said second pilot bore further includes a flow control mechanism comprising:

a threaded adjusting screw;

a bumper member mounted on a first end of said adjusting screw, said bumper member being in contact with one of said first and second cartridge spools, to thereby limit the travel of said one of said first and second cartridge spools, respectively, within said one of said first and second pilot bores; and a lock nut threaded onto said adjusting screw and adapted to selectively prevent rotation of said adjusting screw with respect to said bumper member.

4. A valve according to claim 1 wherein one of said first pilot bore and said second pilot bore further includes a counterbalance mechanism comprising:

a counterbalance adjusting screw and a counterbalance bias spring, said counterbalance adjusting screw biasing said bias spring in a direction against one of said first and said second cartridge spool within one of said first and said second pilot bore, respectively, to close a respective outlet port.

5. A valve according to claim 1 further including a 3-way valve in fluid communication with at least one of said first pilot bore and second pilot bore.

6. A valve according to claim 5 wherein said 3-way valve includes a piston bore and a piston disposed at least partially within said piston bore; and a ball check.

* * * * *